US009359573B2

(12) United States Patent
Baker, Jr. et al.

(10) Patent No.: US 9,359,573 B2
(45) Date of Patent: Jun. 7, 2016

(54) MIGRATION OF AIR RELEASE IN LUBRICANT BASE STOCKS

(71) Applicants: Charles Lambert Baker, Jr., Thornton, PA (US); Beatrice Marie Gooding, Hopewell, NJ (US); Paul Carl Naegely, Voorhees, NJ (US)

(72) Inventors: Charles Lambert Baker, Jr., Thornton, PA (US); Beatrice Marie Gooding, Hopewell, NJ (US); Paul Carl Naegely, Voorhees, NJ (US)

(73) Assignee: EXXONMOBIL RESEARCH AND ENGINEERING COMPANY, Annandale, NJ (US)

( * ) Notice: Subject to any disclaimer, the term of this patent is extended or adjusted under 35 U.S.C. 154(b) by 207 days.

(21) Appl. No.: 13/947,570

(22) Filed: Jul. 22, 2013

(65) Prior Publication Data

US 2014/0038867 A1 Feb. 6, 2014

Related U.S. Application Data

(60) Provisional application No. 61/679,886, filed on Aug. 6, 2012.

(51) Int. Cl.

| | |
|---|---|
| ***C10M 127/02*** | (2006.01) |
| ***C10M 169/04*** | (2006.01) |
| ***C10M 105/02*** | (2006.01) |
| ***C10G 71/00*** | (2006.01) |
| ***C10M 171/00*** | (2006.01) |

(52) U.S. Cl.

CPC ..... *C10M 127/02* (2013.01); *C10G 71/00* (2013.01); *C10M 169/04* (2013.01); *C10M 169/041* (2013.01); *C10M 171/00* (2013.01); *C10M 2203/022* (2013.01); *C10M 2203/04* (2013.01); *C10M 2203/1006* (2013.01); *C10M 2203/1025* (2013.01); *C10M 2203/1085* (2013.01); *C10M 2205/028* (2013.01); *C10M 2205/17* (2013.01); *C10M 2215/28* (2013.01); *C10M 2219/044* (2013.01); *C10M 2219/046* (2013.01); *C10N 2220/022* (2013.01); *C10N 2230/00* (2013.01); *C10N 2230/18* (2013.01)

(58) Field of Classification Search

CPC ..... C10M 127/02; C10M 169/04; C10M 169/041; C10M 171/00; C10M 2203/022; C10M 2203/04; C10M 2203/1006; C10M 2203/1025; C10M 2203/1085; C10M 2205/028; C10M 2205/17; C10M 2215/28; C10M 2219/044; C10M 2219/046; C10N 2220/022; C10N 2230/00; C10N 2230/18; C10G 71/00

USPC ..... 508/290, 110

See application file for complete search history.

(56) References Cited

U.S. PATENT DOCUMENTS

| | | | | |
|---|---|---|---|---|
| 2,733,190 | A * | 1/1956 | Noble | C10G 27/12 208/196 |
| 2,991,245 | A * | 7/1961 | Hartzband | C10M 1/08 208/19 |
| 3,149,178 | A | 9/1964 | Hamilton et al. | |
| 3,382,291 | A | 5/1968 | Brennan | |
| 3,576,923 | A | 4/1971 | Randell et al. | |
| 3,742,082 | A | 6/1973 | Brennan | |
| 3,769,363 | A | 10/1973 | Brennan | |
| 3,780,128 | A | 12/1973 | Shubkin | |
| 3,876,720 | A | 4/1975 | Heilman et al. | |
| 4,149,178 | A | 4/1979 | Estes | |
| 4,172,855 | A | 10/1979 | Shubkin et al. | |
| 4,234,435 | A | 11/1980 | Meinhardt et al. | |
| 4,239,930 | A | 12/1980 | Allphin et al. | |
| 4,263,150 | A | 4/1981 | Clason et al. | |
| 4,289,635 | A | 9/1981 | Schroeck | |
| 4,308,154 | A | 12/1981 | Clason et al. | |
| 4,367,352 | A | 1/1983 | Watts, Jr. et al. | |
| 4,413,156 | A | 11/1983 | Watts, Jr. et al. | |
| 4,417,990 | A | 11/1983 | Clason et al. | |
| 4,434,408 | A | 2/1984 | Baba et al. | |
| 4,568,663 | A | 2/1986 | Mauldin | |
| 4,652,416 | A | 3/1987 | Millot | |
| 4,827,064 | A | 5/1989 | Wu | |
| 4,827,073 | A | 5/1989 | Wu | |
| 4,910,355 | A | 3/1990 | Shubkin et al. | |
| 4,914,254 | A | 4/1990 | Pelrine | |
| 4,926,004 | A | 5/1990 | Pelrine et al. | |
| 4,956,122 | A | 9/1990 | Watts et al. | |
| 4,967,032 | A | 10/1990 | Ho et al. | |
| 5,068,487 | A | 11/1991 | Theriot | |

(Continued)

FOREIGN PATENT DOCUMENTS

| | | | |
|---|---|---|---|
| WO | 2007145923 | A1 | 12/2007 |
| WO | 2008013754 | A2 | 1/2008 |

OTHER PUBLICATIONS

"Diamines and Higher Amines" in The Encyclopedia of Chemical Technology, Second Edition, Kirk and Othmer, vol. 7, pp. 27-39, Interscience Publishers, Division of John Wiley and Sons, 1965.

(Continued)

*Primary Examiner* — James Goloboy

(74) *Attorney, Agent, or Firm* — Robert A. Migliorini

(57) ABSTRACT

A method of improving air release in lubricant base stocks and lubricating oils is provided. The method includes providing a Group I base stock, a Group II base stock or a combination thereof and adding to the base stock an effective amount of $C_7$ to $C_{80}$ paraffin, wherein the lubricant base stock provides air release according to the ASTM D3427 test at least 20% lower than the same lubricant base stock not including the $C_7$ to $C_{80}$ paraffin. Also provided are lube base stocks and lubricating oils with improved air release and methods of making such base stocks and oils.

12 Claims, 1 Drawing Sheet

(56) References Cited

U.S. PATENT DOCUMENTS

| | | | | |
|---|---|---|---|---|
| 5,348,892 | A | 9/1994 | Miyake et al. | |
| 5,545,674 | A | 8/1996 | Behrmann et al. | |
| 6,080,301 | A | 6/2000 | Berlowitz et al. | |
| 6,090,989 | A | 7/2000 | Trewella et al. | |
| 6,156,709 | A * | 12/2000 | Muntz | 508/539 |
| 6,165,949 | A | 12/2000 | Berlowitz et al. | |
| 6,322,692 | B1 * | 11/2001 | Cody et al. | 208/18 |
| 2004/0235682 | A1 * | 11/2004 | Van Dam et al. | 508/192 |
| 2005/0070450 | A1 * | 3/2005 | Roby et al. | 508/486 |
| 2007/0142247 | A1 * | 6/2007 | Baillargeon | C10M 169/04 508/279 |
| 2007/0142250 | A1 | 6/2007 | Loh et al. | |
| 2007/0232503 | A1 * | 10/2007 | Haigh | C10M 111/02 508/192 |
| 2007/0265178 | A1 | 11/2007 | Patil et al. | |
| 2007/0289897 | A1 | 12/2007 | Carey et al. | |
| 2008/0026970 | A1 | 1/2008 | Wright et al. | |
| 2008/0108533 | A1 * | 5/2008 | Peer | C08F 220/18 508/469 |
| 2008/0177121 | A1 | 7/2008 | Wu et al. | |
| 2008/0207475 | A1 | 8/2008 | Haigh et al. | |
| 2012/0115763 | A1 * | 5/2012 | Patil | C08G 65/20 508/556 |

OTHER PUBLICATIONS

Ethylene Amines in Kirk Othmer's "Encyclopedia of Chemical Technology", 2d Edition, vol. 7, pp. 22-37, Interscience Publishers, New York (1965).

Greenwood, W.P., "Advanced High-Performance Synthetic Basestocks", Tribology & Lubrication Technology, Nov. 1, 2006, pp. 36-39.

Basu, B., et al.,"Air-Entrapment Phenomenon in Mineral Lubricating Oils", ASLE Transactions, Engineers, vol. 28, No. 3, Jan. 1, 1985, p. 313-324.

Pillon, L.Z., Chapter 5.2, "Air Entrainment", Surface Activity of Petroleum Derived Lubricants, CRC Press, pp. 135-140, Jan. 1, 2011.

PCT International Search Report for International application No. PCT/US2013/051595, dated Nov. 11, 2013.

* cited by examiner

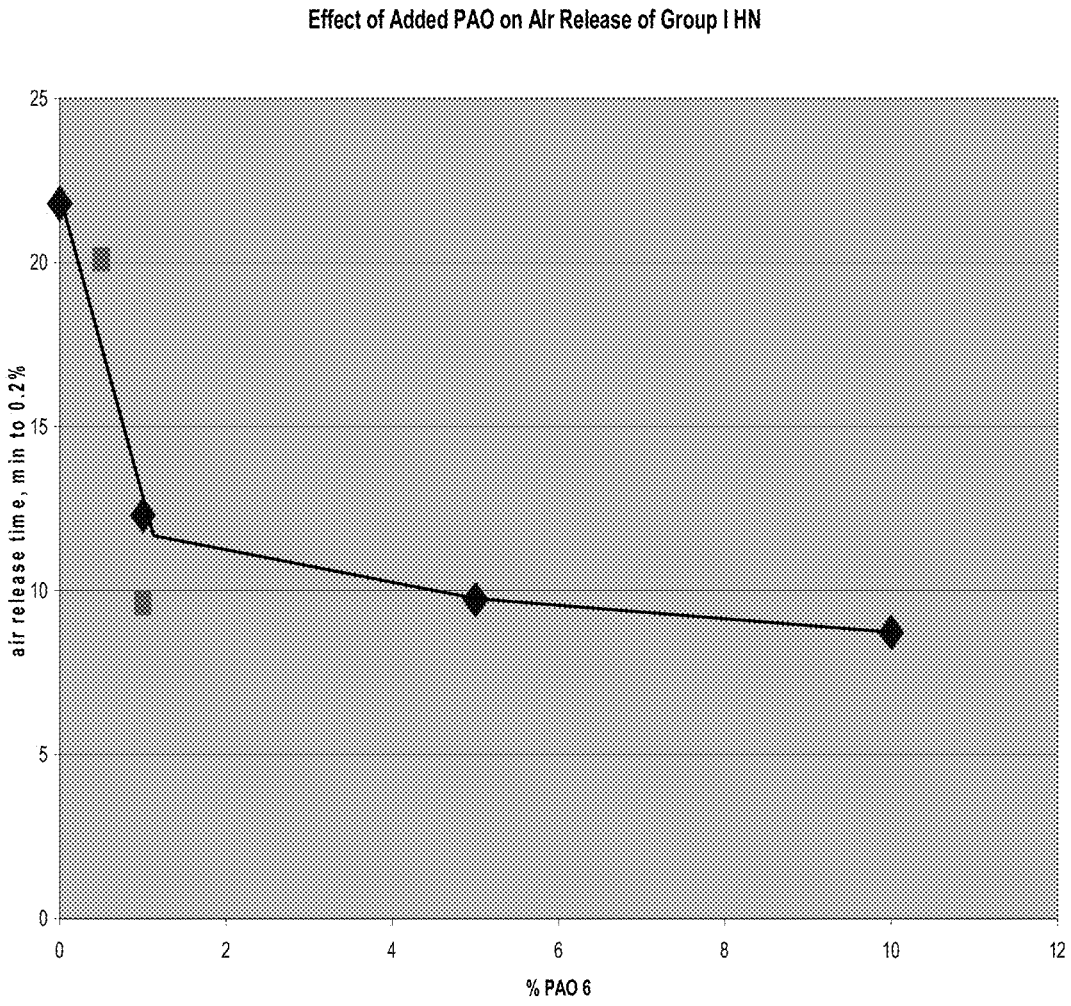
Effect of Added PAO on Air Release of Group I HN
air release time, min to 0.2%
25
20
15
10
5
0
0
2
4
6
8
10
12
% PAO 6

MIGRATION OF AIR RELEASE IN LUBRICANT BASE STOCKS

CROSS-REFERENCE TO RELATED APPLICATIONS

This application claims the benefit of U.S. Provisional Application Ser. No. 61/679,886, filed on Aug. 6, 2012; which is incorporated herein in its entirety by reference.

FIELD

The current disclosure relates to lubricant base stocks. It more particularly relates to the use of components added to lubricant base stocks to more effectively mitigate air release from the base stock.

BACKGROUND

All lubricating oil systems contain some air. It can be found in four phases: free air, dissolved air, entrained air and foam. Free air is trapped in a system, such as an air pocket in a hydraulic line. Dissolved air is in solution with the oil and is not visible to the naked eye. Foam is a collection of closely packed bubbles surrounded by thin films of oil that collect on the surface of the oil.

Air entrainment is a small amount of air in the form of extremely small bubbles (generally less than 1 mm in diameter) dispersed throughout the bulk of the oil. Agitation of lubricating oil with air in equipment, such as bearings, couplings, gears, pumps, and oil return lines, may produce a dispersion of finely divided air bubbles in the oil. If the residence time in the reservoir is too short to allow the air bubbles to rise to the oil surface, a mixture of air and oil will circulate through the lubricating oil system. This may result in an inability to maintain oil pressure (particularly with centrifugal pumps), incomplete oil films in bearings and gears, and poor hydraulic system performance or failure. Air entrainment is treated differently than foam, and is most often a completely separate problem. A partial list of potential effects of air entrainment include: pump cavitation, spongy, erratic operation of hydraulics, loss of precision control; vibrations, oil oxidation, component wear due to reduced lubricant viscosity, equipment shut down when low oil pressure switches trip, "micro-dieseling" due to ignition of the bubble sheath at the high temperatures generated by compressed air bubbles, safety problems in turbines if overspeed devices do not react quickly enough, and loss of head in centrifugal pumps.

Antifoamants, including silicone additives help produce smaller bubbles in the bulk of the oil. In stagnant systems, the combination of smaller bubbles and greater sheath density can cause serious air entrainment problems. Turbine oil systems with quiescent reservoirs of several thousand gallons may have air entrainment problems with as little as a half a part per million silicone.

Casual exposure to silicone can have a significant effect on the lubricant. There are reports of air entrainment resulting from oil passing through hoses that had been formed on a silicone-coated mandrel. In one instance in a turbine application, all sources of air were removed, and the system was carefully evaluated, component by component, to check for sources of contamination. After an exhaustive search, the culprit was found to be a silicone coating on electrical cables that were immersed in oil. Other known causes of entrainment problems include contaminants, overadditizing and reservoir design.

One widely method to test air release properties of petroleum oils is ASTM D3427-03. This test method measures the time for the entrained air content to fall to the relatively low value of 0.2% under a standardized set of test conditions and hence permits the comparison of the ability of oils to separate entrained air under conditions where a separation time is available. The significance of this test method has not been fully established. However, entrained air can cause sponginess and lack of sensitivity of the control of turbine and hydraulic systems. This test may not be suitable for ranking oils in applications where residence times are short and gas contents are high.

In the ASTM D3427 method, compressed air is blown through the test oil, which has been heated to a temperature of 25, 50, or 75° C. After the air flow is stopped, the time required for the air entrained in the oil to reduce in volume to 0.2% is usually recorded as the air release time.

Most solutions to the air entrainment problem have been to redesign the reservoir or choose additives not likely to cause aeration issues. There is a need to create new base stocks, lubricant, additives and combinations thereof that have improved air release properties to reduce aeration issues. Accordingly, this disclosure satisfies that need.

SUMMARY

Methods of achieving favorable air release properties in lubricant base stocks are disclosed. In one embodiment, a method of mitigating air release in lubricant base stocks comprises providing a Group I base stock, a Group II base stock or a combination thereof and adding to the base stock an effective amount of $C_7$ to $C_{80}$ paraffin, wherein the lubricant base stock provides air release according to the ASTM D3427 test of at least 20% lower than the same base stock not including the $C_7$ to $C_{80}$ paraffin.

In a second embodiment, a lubricant base stock is disclosed comprising a Group I base stock, a Group II base stock or a combination thereof and an effective amount of $C_7$ to $C_{80}$ paraffin, wherein the lubricant base stock provides air release according to the ASTM D3427 test of at least 20% lower than the same base stock not including the $C_7$ to $C_{80}$ paraffin.

In a third embodiment, a method of making a lubricant base stock with improved air release properties comprises providing a Group I base stock, a Group II base stock or a combination thereof and adding to the base stock an effective amount of $C_7$ to $C_{80}$ paraffin, wherein the lubricant base stock provides air release according to the ASTM D3427 test of at least 20% lower than the same base stock not including the $C_7$ to $C_{80}$ paraffin.

In a fourth embodiment, a method of mitigating air release in a lubricating oil comprises providing a lubricant oil composition including a Group I base stock, a Group II base stock or a combination thereof and adding to the lubricant oil composition an effective amount of $C_7$ to $C_{80}$ paraffin, wherein the air release time to 0.2% air in the ASTM D3427 test of the lubricating oil is at least 20% lower than the same lubricating oil without the $C_7$ to $C_{80}$ paraffin.

In a fifth embodiment, a lubricating oil is disclosed comprising a Group I base stock, a Group II base stock or a combination thereof and an effective amount of $C_7$ to $C_{80}$ paraffin, wherein the air release time to 0.2% air in the ASTM D3427 test of the lubricating oil is at least 20% lower than the same lubricating oil without the $C_7$ to $C_{80}$ paraffin.

In a sixth embodiment, a method of making a lubricant oil composition with improved air release properties comprises providing lubricant oil composition including a Group I base stock, a Group II base stock or a combination thereof and adding to the lubricant composition an effective amount of $C_7$ to $C_{80}$ paraffin, wherein the air release time to 0.2% air in the ASTM D3427 test of the lubricating oil is at least 20% lower than the same lubricating oil without the $C_7$ to $C_{80}$ paraffin.

In a seventh embodiment, a method of making a lubricant base stock with improved air release properties comprises providing a Group I base stock, a Group II base stock or a combination thereof and extracting the base stock with a solvent chosen from methanol, ethanol, propanol, NMP, furfural, tetrahydrofuran, and DMSO, wherein the air release time to 0.2% air in the ASTM D3427 test of the lubricant base stock is at least 20% lower than the same base stock without the extraction step.

These and other features and attributes of the disclosed methods of mitigating air release in lubricant base stocks and lubricating oils of the present disclosure and their advantageous applications and/or uses will be apparent from the detailed description which follows, particularly when read in conjunction with the figures appended hereto.

BRIEF DESCRIPTION OF THE DRAWINGS

To assist those of ordinary skill in the relevant art in making and using the subject matter hereof, reference is made to the appended drawings, wherein:

FIG. 1 is a plot of the air release of a Group I lube base stock with the addition of PAO.

DETAILED DESCRIPTION

All numerical values within the detailed description and the claims herein are modified by "about" or "approximately" the indicated value, and take into account experimental error and variations that would be expected by a person having ordinary skill in the art.

Overview

As discussed above, air release in base stocks has been a long term problem and in particular for Group I base stocks and Group II base stocks. Group I base stocks generally have air release values of 6 to 20 minute at 0.2% air. Also as the viscosity of the base stock decreases, the air release also decreases. Hence, more viscous base stocks generally have higher air release values. In contrast, Group II base stocks have air release values ranging from 3.5 to 6.0 minutes at 0.2% air. Group II base stocks are less variable in air release values compared to Group I base stocks. Hence, high viscosity Group I base stocks have poor air release properties.

The Applicants have unexpectedly and surprisingly discovered that when a paraffinic material in the range of $C_7$ to $C_{80}$ is added to a Group I base stock, a Group II base stock, or a combination of a Group I and Group II base stock, there is an unexpected improvement in the air release properties of the base stock. The paraffinic material may be a low molecular weight paraffin, such as heptane, or a high molecular weight paraffin, such as a poly alpha olefin. Another group of paraffinic materials that improve the air release properties of Group I and Group II base stocks are GTL (Gas to Liquids) materials.

In one embodiment, a method of mitigating air release in lubricant base stocks comprises providing a Group I base stock, a Group II base stock or a combination thereof and adding to the base stock an effective amount of $C_7$ to $C_{80}$ paraffin, wherein the air release time to 0.2% air in the ASTM D3427 test of the lubricant base stock is at least 20% lower than the same base stock without the $C_7$ to $C_{80}$ paraffin.

In a second embodiment, a lubricant base stock is disclosed comprising a Group I base stock, a Group II base stock or a combination thereof and an effective amount of $C_7$ to $C_{80}$ paraffin, wherein the air release time to 0.2% air in the ASTM D3427 test of the lubricant base stock is at least 20% lower than the same base stock without the $C_7$ to $C_{80}$ paraffin.

In a embodiment a method of making a lubricant base stock with improved air release properties comprises providing a Group I base stock, a Group II base stock or a combination thereof and adding to the base stock an effective amount of $C_7$ to $C_{80}$ paraffin, wherein the air release time to 0.2% air in the ASTM D3427 test of the lubricant base stock is at least 20% lower than the same base stock without the $C_7$ to $C_{80}$ paraffin.

In fourth embodiment, a method of mitigating air release in a lubricating oil comprises providing a lubricant oil composition including a Group I base stock, a Group II base stock or a combination thereof and adding to the lubricant oil composition an effective amount of $C_7$ to $C_{80}$ paraffin, wherein the air release time to 0.2% air in the ASTM D3427 test of the lubricating oil is at least 20% lower than the same lubricating oil without the $C_7$ to $C_{80}$ paraffin.

In a fifth embodiment, a lubricating oil is disclosed comprising a Group I base stock, a Group II base stock or a combination thereof and an effective amount of $C_7$ to $C_{80}$ paraffin, wherein the air release time to 0.2% air in the ASTM D3427 test of the lubricating oil is at least 20% lower than the same lubricating oil without the $C_7$ to $C_{80}$ paraffin.

In a sixth embodiment, a method of making a lubricant oil composition with improved air release properties comprises providing lubricant oil composition including a Group I base stock, a Group II base stock or a combination thereof and adding to the lubricant composition an effective amount of $C_7$ to $C_{80}$ paraffin, wherein the air release time to 0.2% air in the ASTM D3427 test of the lubricating oil is at least 20% lower than the same lubricating oil without the $C_7$ to $C_{80}$ paraffin.

In a seventh embodiment, a method of making a lubricant base stock with improved air release properties comprises providing a Group I base stock, a Group II base stock or a combination thereof and extracting the base stock with a solvent chosen from methanol, ethanol, propanol, NMP, furfural, tetrahydrofuran, and DMSO, wherein the air release time to 0.2% air in the ASTM D3427 test of the lubricant base stock is at least 20% lower than the same base stock without the extraction step.

In other embodiments, the lubricant base stocks and lubricating oils with improved air release properties disclosed herein may provide an air release values of less than 20, or less than 18 or less than 16, or less than 14, or less than 12, or less than 10, or less than 8, or less than 6, or less than 4, or less than 2 minutes time to 0.2% air in the ASTM D3427 test. In other embodiments, the lubricant base stocks and lubricating oils with improved air release properties including the effective amount of a $C_7$ to $C_{80}$ paraffinic material disclosed herein may provide a percent decrease in air release time to 0.2% air in the ASTM D3427 test of at least 5%, or at least 10%, or at least 15%, or at least 20%, or at least 25%, or at least 30%, or at least 35%, or at least 40%, or at least 45%, or at least 50%, or at least 55%, or at least 60% lower, or at least 70% lower, or at least 80% lower than the same lubricant base stock and same lubricating oil not including the $C_7$ to $C_{80}$ paraffinic material.

The loading level in weight % of the paraffinic material in the lubricant base stock and lubricant oil composition needed to improve air release properties is an effective amount and generally in the range of 0.03 to 10 wt %. The lower limit for the loading of the paraffinic material in the base stock may be 0.02, or 0.05, or 0.08, or 0.1, or 0.2, or 0.3, or 0.4, or 0.5, or 0.6, or 0.7, or 0.8, or 0.9, or 1.0, or 1.2, or 1.4, or 1.6, or 1.8, or 2.0, or 3.0, or 4.0 wt %. The upper limit for the loading of the paraffinic material in the base stock may be 1.0, or 2.0, or 3.0, or 4.0, or 5.0, or 6.0, or 7.0, or 8.0, or 9.0, or 10.0 wt %.

The paraffinic materials disclosed herein are also effective in mitigating the negative impact on air release properties caused by the inclusion of certain additives in formulating a lubricant oil composition from a Group I base stock, a Group II base stock or a combination of a Group I and a Group II base stock. For example, detergents are generally known to increase the air release values of Group I and Group II base stocks when added to form a lubricant oil composition. The Applicants have discovered that the inclusion of an effective amount of a $C_7$ to $C_{80}$ paraffinic material may offset the increase in air release values caused by the inclusion of detergent additives in the lubricant oil composition. In particular, alkaline sulfonates and ester succinimides detergent additives in lubricant oil compositions cause a significant increase in the air release of Group I and Group II base stock. The inclusion in the lubricant oil composition of an effective amount of a $C_7$ to $C_{80}$ paraffinic material can be used to partially or even completely offset the increase in the air release values caused by the addition of detergents to lubricating oils. Other lubricant additives are also known to increase air release, besides detergents. For example, defoamants (foam inhibitors) and dispersants are also known to increase air release. Hence, the methods of improving air release values of lubricant base stocks including Group I and Group II base stocks are also directly applicable to lubricant oil compositions/lubricating oils including Group I and Group II base stocks.

Lubricant Base Stocks

The methods of mitigating air release in lubricant base stocks of the instant disclosure find particular application in Group I base stocks, Group II base stocks, and combinations of Group I and Group II base stocks because of their inherently poor air release properties. In particular, the methods of mitigating air release of the present disclosure are particularly applicable to high viscosity Group I base stocks because of their poor air release properties. Non-limiting exemplary Group I base stocks include Group I light neutral (KV of 4 to 6 cSt at 100° C.), Group I heavy neutral (KV of 10 to 12 cSt at 100° C.) and bright stock (KV of 30 to 34 cSt at 100° C.). The lubricant base stocks of the present disclosure may optionally have a second base stock, such as a Group III base stock, GTL base stock, or PAO base stock. Useful Group I-III base stocks have a $Kv_{100}$ (kinetic viscosity) of between 2 to 50 cSt, or 4 to 20 cSt, or 3 to 5 cSt. API Groups I, II, and III represent base stocks typically refined from crude oil and are differentiated by viscosity index (VI), saturation content, and sulfur content.

The specifications for the lube base oils are defined in the API Interchange Guidelines (API Publication 1509) using sulfur content, saturates content, and viscosity index, as follows:

| Group | Sulfur (ppm) | Saturates (%) | Viscosity Index (VI) |
|---|---|---|---|
| I | >300 | <90 | 80-120 |
| II | <300 | >90 | 80-120 |
| III | <300 | >90 | >120 |
| IV | All Polyalphaolefins (PAOs) | | |
| V | All Stocks Not Included in Groups I-IV | | |

Other important lube base stocks are the Groups I, II, and III base stocks. Groups I, II, and III base stocks are disclosed in "Synthetics, Mineral Oils and Bio-Based Lubricants, Chemistry and Technology" Edited by L. R. Rudnick, published by CRC Press, Taylor & Francis, 2005, which is incorporated herein by reference.

Manufacturing plants that make Group I base oils typically use solvents to extract the lower viscosity index (VI) components and increase the VI of the crude to the specifications desired. These solvents are typically phenol or furfural. Solvent extraction gives a product with less than 90% saturates and more than 300 ppm sulfur. The majority of the lube production in the world is in the Group I category.

Manufacturing plants that make Group II base oils typically employ hydroprocessing such as hydrocracking or severe hydrotreating to increase the VI of the crude oil to the specifications value. The use of hydroprocessing typically increases the saturate content above 90 and reduced the sulfur below 300 ppm. Approximately 10% of the lube base oil production in the world is in the Group II category, and 30% of U.S. production is Group II.

Manufacturing plants that make Group III base oils typically employ wax isomerization technology to make very high VI products. Since the starting feed is waxy vacuum gas oil (VGO) or wax which contains all saturates and little sulfur, the Group III products have saturate contains above 90 and sulfur content below 300 ppm.

Paraffin Material Additives

Non-limiting exemplary paraffin materials are effective in improving air release in Group I and Group II base stocks include: n-hexane, n-heptane, n-dodecane, nonadecane, n-hexadecane, cyclohexane, PAO (2, 4, 6, and higher cSt KV at 100° C.), and GTL (2, 4, 6, and higher cSt KV at 100° C.). One class of paraffin materials that are useful for mitigating air release in Group I and Group II base stocks are low molecular weight paraffins. Another class of paraffin materials that are useful for mitigating air release in Group I and Group II base stocks are high molecular weight paraffins. The paraffins for mitigating air release of the present disclosure may range from $C_7$ to $C_{100}$, or $C_7$ to $C_{80}$, or $C_7$ to $C_{60}$, or $C_7$ to $C_{50}$, or $C_7$ to $C_{40}$, or $C_7$ to $C_{36}$, or $C_7$ to $C_{34}$, or $C_7$ to $C_{30}$, or $C_7$ to $C_{20}$. These paraffinic materials can be further sub-classified as follows:

A. Low Molecular Weight Paraffins:

The low molecular weight paraffins are preferably straight chain alkanes or n-alkanes although isoparaffins may also be used. Non-limiting exemplary straight chain paraffins include heptane, octane, nonane, decane, tridecane, tetradecane, pentadecane, hexadecane, heptadecane, octadecane, nonadecane, icosane, henicosane, docosane, tricosane, tetracosane, pentacosane, hexacosane, heptacosane, octacosane, nonacosane, triacontane, hentriacontane, dotriacontane, tritroacontane, pentatriacontane, hexatriacontane, hentriacontane, dotriacontane, tritriacontane, pentatricontane, hextriacontane, and combinations thereof. In addition, branched versions or isomers of the above straight chain paraffins may also be used to improve air release properties of lubricant base stocks.

One particularly advantageous alkane for mitigating air release in Group I and Group II base stocks is n-heptane, which is a straight-chain alkane with the chemical formula $H_3C(CH_2)_5CH_3$ or $C_7H_{16}$ having a boiling point of 98° C., a melting point of −91° C. and a density of 0.684 g/cc. Branched or isoheptane may also be used to mitigate air release. Isomers of n-heptane include 2-Methylhexane (isoheptane), 3-Methylhexane, 2,2-Dimethylpentane, 2,3-Dimethylpentane, 2,4-Dimethylpentane, 3,3-Dimethylpentane, 3-Ethylpentane, and 2,2,3-Trimethylbutane.

The properties of exemplary higher straight chain alkanes disclosed above are given in the tables below.

Table of nonane to hexadecane which are generally liquid under natural conditions.

| | Nonane | Decane | Undecane | Dodecane | Tridecane | Tetradecane | Pentadecane | Hexadecane |
|---|---|---|---|---|---|---|---|---|
| Formula | $C_9H_{20}$ | $C_{10}H_{22}$ | $C_{11}H_{24}$ | $C_{12}H_{26}$ | $C_{13}H_{28}$ | $C_{14}H_{30}$ | $C_{15}H_{32}$ | $C_{16}H_{34}$ |
| CAS number | [111-84-2] | [124-18-5] | [1120-21-4] | [112-40-3] | [629-50-5] | [629-59-4] | [629-62-9] | [544-76-3] |
| Molar mass (g/mol) | 128.26 | 142.29 | 156.31 | 170.34 | 184.37 | 198.39 | 212.42 | 226.45 |
| Melting point (° C.) | −53 | −30 | −26 | −9.6 | −5 | 5.5 | 9.9 | 18 |
| Boiling point (° C.) | 151 | 174 | 196 | 216.2 | 234 | 253 | 268-270 | 287 |
| Density (g/ml) | 0.718 | 0.73 | 0.74 | 0.75 | | 0.763 | 0.769 | 0.773 |
| Viscosity (cP at 20° C.) | 0.711 | 0.92 | | 1.35 | | 2.18 | | 3.34 |
| Flash point (° C.) | 31 | 46 | 60 | 71 | 102 | 99 | 132 | 135 |
| Autoignition temperature (° C.) | 205 | 210 | | 205 | | 235 | | 201 |
| Explosive limits | 0.9-2.9% | 0.8-2.6% | | | | | 0.45-6.5% | |

Table of heptadecane to tetracosane, which are generally solid under natural conditions.

| | Heptadecane | Octadecane | Nonadecane | Icosane | Henicosane | Docosane | Tricosane | Tetracosane |
|---|---|---|---|---|---|---|---|---|
| Formula | $C_{17}H_{36}$ | $C_{18}H_{38}$ | $C_{19}H_{40}$ | $C_{20}H_{42}$ | $C_{21}H_{44}$ | $C_{22}H_{46}$ | $C_{23}H_{48}$ | $C_{24}H_{50}$ |
| CAS number | [629-78-7] | [593-45-3] | [629-92-5] | [112-95-8] | [629-94-7] | [629-97-0] | [638-67-5] | [646-31-1] |
| Molar mass (g/mol) | 240.47 | 254.50 | 268.53 | 282.55 | 296.58 | 310.61 | 324.63 | 338.66 |
| Melting point (° C.) | 21 | 28-30 | 32-34 | 36.7 | 40.5 | 42 | 48-50 | 52 |
| Boiling point (° C.) | 302 | 317 | 330 | 342.7 | 356.5 | 224 at 2 kPa | 380 | 391.3 |
| Density (g/ml) | 0.777 | 0.777 | | | 0.792 | | 0.797 | |
| Flash Point (° C.) | 148 | 165 | 168 | | | | | |

Table of pentacosane to triacontane. which are generally solid under natural conditions.

| | Pentacosane | Hexacosane | Heptacosane | Octacosane | Nonacosane | Triacontane |
|---|---|---|---|---|---|---|
| Formula | $C_{25}H_{52}$ | $C_{26}H_{54}$ | $C_{27}H_{56}$ | $C_{28}H_{58}$ | $C_{29}H_{60}$ | $C_{30}H_{62}$ |
| CAS number | [629-99-2] | [630-01-3] | [593-49-7] | [630-02-4] | [630-03-5] | [638-68-6] |
| Molar mass (g/mol) | 352.69 | 366.71 | 380.74 | 394.77 | 408.80 | 422.82 |
| Melting point (° C.) | 54 | 56.4 | 59.5 | 64.5 | 63.7 | 65.8 |
| Boiling point (° C.) | 401.9 | 412.2 | 422 | 431.6 | 440.8 | 449.7 |
| Density (g/ml) | 0.801 | 0.778 | 0.780 | 0.807 | 0.808 | 0.810 |

Table of hentriacontane to hexatriacontane, which are generally solid under natural conditions.

| | Hentriacontane | Dotriacontane | Tritriacontane | Tetratriacontane | Pentatriacontane | Hexatriacontane |
|---|---|---|---|---|---|---|
| Formula | $C_{31}H_{64}$ | $C_{32}H_{66}$ | $C_{33}H_{68}$ | $C_{34}H_{70}$ | $C_{35}H_{72}$ | $C_{36}H_{74}$ |
| CAS number | [630-04-6] | [544-85-4] | [630-05-7] | [14167-59-0] | [630-07-9] | [630-06-8] |
| Molar mass (g/mol) | 436.85 | 450.88 | 464.90 | 478.93 | 492.96 | 506.98 |
| Melting point (° C.) | 67.9 | 69 | 70-72 | 72.6 | 75 | 74-76 |
| Boiling point (° C.) | 458 | 467 | | 285.4 at 0.4 kPa | 490 | 265 at 130 Pa |

Non-limiting exemplary branched or iso-paraffins (isoalkanes) include methyl-heptane, and methyl-pentadecane.

B. Poly Alpha Olefins:

Another class of paraffin materials that are useful for mitigating air release in Group I and Group II base stocks are poly alpha olefins (PAOs). PAOs are a class of hydrocarbons that can be manufactured by the catalytic oligomerization (polymerization to low-molecular-weight products) of linear α-olefin (LAO) monomers. These typically range from 1-octene to 1-dodecene, or 1-octene to 1-tetradecene, with 1-decene being a preferred material, although oligomeric copolymers of lower olefins such as ethylene and propylene may also be used, including copolymers of ethylene with higher olefins as described in U.S. Pat. No. 4,956,122 and the patents referred to therein, all of which are incorporated by reference in their entireties. PAO products have achieved importance in the lubricating oil market. Typically there are two classes of synthetic hydrocarbon fluids (SHF) produced from linear alpha-olefins, the two classes of SHF being denoted as PAO and HVI-PAO (high viscosity index PAO's). PAO's of different viscosity grades are typically produced using promoted $BF_3$ or $AlCl_3$ catalysts.

Specifically, PAOs may be produced by the polymerization of olefin feed in the presence of a catalyst, such as $AlCl_3$, $BF_3$, or promoted $AlCl_3$ or $BF_3$. Processes for the production of PAOs are disclosed, for example, in the following patents: U.S. Pat. Nos. 3,149,178; 3,382,291; 3,742,082; 3,769,363; 3,780,128; 4,172,855 and 4,956,122, which are fully incorporated herein by reference. PAOs are also discussed in the following: Will, J. G. *Lubrication Fundamentals*, Marcel Dekker: New York, 1980. Subsequent to polymerization, the PAO lubricant range products are typically hydrogenated in order to reduce the residual unsaturation, generally to a level of greater than 90% of hydrogenation. High viscosity PAO's may be conveniently made by the polymerization of an alpha-olefin in the presence of a polymerization catalyst such as Friedel-Crafts catalysts. These include, for example, boron trifluoride, aluminum trichloride, or boron trifluoride, promoted with water, with alcohols such as ethanol, propanol, or butanol, with carboxylic acids, or with esters such as ethyl acetate or ethyl propionate or ether such as diethyl ether, and diisopropyl ether. (See for example, the methods disclosed by U.S. Pat. Nos. 4,149,178 and. 3,382,291.) Other descriptions of PAO synthesis are found in the following: U.S. Pat. No. 3,742,082; U.S. Pat. No. 3,769,363; U.S. Pat. No. 3,876,720; U.S. Pat. No. 4,239,930; U.S. Pat. No. 4,367,352; U.S. Pat. No. 4,413,156; U.S. Pat. No. 4,434,408; U.S. Pat. No. 4,910,355; U.S. Pat. No. 4,956,122; and U.S. Pat. No. 5,068,487, all of which are incorporated in their entirety herein by reference.

Another class of HVI-PAOs may be prepared by the action of a supported, reduced chromium catalyst with an alpha-olefin monomer. Such PAOs are described in U.S. Pat. No. 4,827,073; U.S. Pat. No. 4,827,064; U.S. Pat. No. 4,967,032; U.S. Pat. No. 4,926,004; and U.S. Pat. No. 4,914,254. Commercially available PAOs include SpectraSyn™ 2, 4, 5, 6, 8, 10, 40, 100 and SpectraSyn Ultra™ 150, SpectraSyn Ultra™ 300, SpectraSyn Ultra™ 1000, etc. (ExxonMobil Chemical Company, Houston, Tex.). Also included are PAOs prepared the presence of a metallocene catalyst with a non-coordinating anion activator and hydrogen as discussed in U.S. Published Patent Application No. 2008/0177121.

The PAO materials disclosed above are characterized typically as having kinematic viscosities at 100° C. of from 2 cSt to 50 cSt, preferably from 3 cSt to 50 cSt, more preferably from 4 cSt to 30 cSt.

C. GTL Materials:

Still another class of paraffin materials that are useful for mitigating air release in Group I and Group II base stocks are Gas-to-Liquids materials (GTLs). GTL materials that are derived via one or more synthesis, combination, transformation, rearrangement, and/or degradation/deconstructive processes from gaseous carbon-containing compounds. GTLs are disclosed as lube base stocks, for example, in U.S. Published Application No. 2007/0265178, which is incorporated herein by reference. Preferably, the GTL base stocks are derived from the Fischer-Tropsch (F-T) synthesis process wherein a synthesis gas comprising a mixture of $H_2$ and CO is catalytically converted to lower boiling materials by hydroisomerization and/or dewaxing. The process is described, for example, in U.S. Pat. Nos. 5,348,982 and 5,545,674, and examples of suitable catalysts are described in U.S. Pat. No. 4,568,663, each of which is incorporated herein by reference.

GTL base stocks and base oils are GTL materials of lubricating viscosity that are generally derived from hydrocarbons, for example waxy synthesized hydrocarbons, that are themselves derived from simpler gaseous carbon-containing compounds, hydrogen-containing compounds and/or elements as feedstocks. GTL base stock(s) include oils boiling in the lube oil boiling range separated/fractionated from GTL materials such as by, for example, distillation or thermal diffusion, and subsequently subjected to well-known catalytic or solvent dewaxing processes to produce lube oils of reduced/low pour point; wax isomerates, comprising, for example, hydroisomerized or isodewaxed synthesized hydrocarbons; hydroisomerized or isodewaxed Fischer-Tropsch ("F-T") material (i.e., hydrocarbons, waxy hydrocarbons, waxes and possible analogous oxygenates); preferably hydroisomerized or isodewaxed F-T hydrocarbons or hydroisomerized or isodewaxed F-T waxes, hydroisomerized or isodewaxed synthesized waxes, or mixtures thereof.

GTL materials are characterized typically as having kinematic viscosities at 100° C. of from 2 cSt to 50 cSt, preferably from 3 cSt to 50 cSt, more preferably from 3.5 cSt to 30 cSt.

The GTL base stock and/or other hydrodewaxed, or hydroisomerized/catalytically (or solvent) dewaxed wax derived base stocks used in the present disclosure have kinematic viscosities at 100° C. in the range of 3.5 cSt to 7 cSt, preferably 4 cSt to 7 cSt, more preferably 4.5 cSt to 6.5 cSt. GTL base stock(s) derived from GTL materials, especially, hydroisomerized/isodewaxed F-T material derived base stock(s), and other hydroisomerized/isodewaxed wax derived base stock(s) are characterized typically as having kinematic viscosities at 100° C. of from 2 $mm^2/s$ to 50 $mm^2/s$, preferably from 3 $mm^2/s$ to 50 $mm^2/s$, more preferably from 3.5 $mm^2/s$ to 30 $mm^2/s$, as exemplified by a GTL base stock derived by the isodewaxing of F-T wax, which has a kinematic viscosity of 4 $mm^2/s$ at 100° C. and a viscosity index of 130 or greater. The term GTL base oil/base stock and/or wax isomerate base oil/base stock as used herein and in the claims is to be understood as embracing individual fractions of GTL base stock/base oil or wax isomerate base stock/base oil as recovered in the production process, mixtures of two or more GTL base stocks/base oil fractions and/or wax isomerate base stocks/base oil fractions, as well as mixtures of one or two or more low viscosity GTL base stock(s)/base oil fraction(s) and/or wax isomerate base stock(s)/base oil fraction(s) with one, two or more high viscosity GTL base stock(s)/base oil fraction(s) and/or wax isomerate base stock(s)/base oil fraction(s) to produce a dumbbell blend wherein the blend exhibits a viscosity within the aforesaid recited range. Reference herein to Kinematic viscosity refers to a measurement made by ASTM method D445.

GTL base stocks and base oils derived from GTL materials, especially hydroisomerized/isodewaxed F-T material derived base stock(s), and other hydroisomerized/isodewaxed wax-derived base stock(s), such as wax hydroisomerates/isodewaxates, which can be used as base stock components of this invention are further characterized typically as having pour points of −5° C. or lower, preferably −10° C. or lower, more preferably −15° C. or lower, still more preferably −20° C. or lower, and under some conditions may have advantageous pour points of −25° C. or lower, with useful pour points of −30° C. to −40° C. or lower. If necessary, a separate dewaxing step may be practiced to achieve the desired pour point. References herein to pour point refer to measurement made by ASTM D97 and similar automated versions.

The GTL base stock(s) derived from GTL materials, especially hydroisomerized/isodewaxed F-T material derived base stock(s), and other hydroisomerized/isodewaxed wax-derived base stock(s) which are base stock components which can be used in this invention are also characterized typically as having viscosity indices of 80 or greater, preferably 100 or greater, and more preferably 120 or greater. Additionally, in certain particular instances, viscosity index of these base stocks may be preferably 130 or greater, more preferably 135 or greater, and even more preferably 140 or greater. For example, GTL base stock(s) that derive from GTL materials preferably F-T materials especially F-T wax generally have a viscosity index of 130 or greater. References herein to viscosity index refer to ASTM method D2270.

In addition, the GTL base stock(s) are typically highly paraffinic of greater than 90 percent saturates), and may contain mixtures of monocycloparaffins and multicycloparaffins in combination with non-cyclic isoparaffins. The ratio of the naphthenic (i.e., cycloparaffin) content in such combinations varies with the catalyst and temperature used. Further, GTL base stocks and base oils typically have very low sulfur and nitrogen content, generally containing less than 10 ppm, and more typically less than 5 ppm of each of these elements. The sulfur and nitrogen content of GTL base stock and base oil obtained by the hydroisomerization/isodewaxing of F-T material, especially F-T wax is essentially nil.

In a preferred embodiment, the GTL base stock(s) comprises paraffinic materials that consist predominantly of non-cyclic isoparaffins and only minor amounts of cycloparaffins. These GTL base stock(s) typically comprise paraffinic materials that consist of greater than 60 wt % non-cyclic isoparaffins, preferably greater than 80 wt % non-cyclic isoparaffins, more preferably greater than 85 wt % non-cyclic isoparaffins, and most preferably greater than 90 wt % non-cyclic isoparaffins.

Useful compositions of GTL base stock(s), hydroisomerized or isodewaxed F-T material derived base stock(s), and wax-derived hydroisomerized/isodewaxed base stock(s), such as wax isomerates/isodewaxates, are recited in U.S. Pat. Nos. 6,080,301; 6,090,989, and 6,165,949 for example.

We have also discovered that the lubricant base stocks with improved air release properties can impart even further enhanced air release properties when combined with specific additive systems. The additives include various commercially available oil packages. These additive packages include a high performance series of components that include antiwear, antioxidant, defoamant, demulsifier, detergent, dispersant, metal passivation, and rust inhibition additive chemistries to deliver desired performance.

Other Additives:

The additives may be chosen to modify various properties of the lubricating oils. For wind turbines, the additives should provide the following properties, antiwear protection, rust protection, micropitting protection, friction reduction, and improved filterability. Persons skilled in the art will recognize various additives that can be chosen to achieve favorable properties. These favorable properties include air release, scanning Brookfield Viscosities, and pour points.

In various embodiments, it will be understood that other additives well known as functional fluid additives in the art, can also be incorporated in the functional fluid composition of the invention, in relatively small amounts, if desired; frequently, less than 0.001% up to 10-20% or more. In one embodiment, at least one oil additive is added from the group consisting of antioxidants, stabilizers, antiwear additives, dispersants, detergents, antifoam additives, viscosity index improvers, copper passivators, metal deactivators, rust inhibitors, corrosion inhibitors, pour point depressants, demulsifiers, anti-wear agents, extreme pressure additives and friction modifiers. The additives listed below are non-limiting examples and are not intended to limit the claims.

A. Dispersants:

Dispersants should contain the alkenyl or alkyl group R has an Mn value of 500 to 5000 and an Mw/Mn ratio of 1 to 5. The preferred Mn intervals depend on the chemical nature of the agent improving filterability. Polyolefinic polymers suitable for the reaction with maleic anhydride or other acid materials or acid forming materials, include polymers containing a predominant quantity of $C_2$ to $C_5$ monoolefins, for example, ethylene, propylene, butylene, isobutylene and pentene. A highly suitable polyolefinic polymer is polyisobutene. The succinic anhydride preferred as a reaction substance is PIBSA; that is, polyisobutenyl succinic anhydride.

If the dispersant contains a succinimide comprising the reaction product of a succinic anhydride with a polyamine, the alkenyl or alkyl substituent of the succinic anhydride serving as the reaction substance consists preferably of polymerized isobutene having an Mn value of 1200 to 2500. More advantageously, the alkenyl or alkyl substituent of the succinic anhydride serving as the reaction substance consists in a polymerized isobutene having an Mn value of 2100 to 2400.

If the agent improving filterability contains an ester of succinic acid comprising the reaction product of a succinic anhydride and an aliphatic polyhydric alcohol, the alkenyl or alkyl substituent of the succinic anhydride serving as the reaction substance consists advantageously of a polymerized isobutene having an Mn value of 500 to 1500. In preference, a polymerized isobutene having an Mn value of 850 to 1200 is used.

Amides suitable uses of amines include antiwear agents, extreme pressure additives, friction modifiers or Dispersants. The amides which are utilized in the compositions of the present invention may be amides of mono- or polycarboxylic acids or reactive derivatives thereof. The amides may be characterized by a hydrocarbyl group containing from 6 to 90 carbon atoms; each is independently hydrogen or a hydrocarbyl, aminohydrocarbyl, hydroxyhydrocarbyl or a heterocyclic-substituted hydrocarbyl group, provided that both are not hydrogen; each is, independently, a hydrocarbylene group containing up to 10 carbon atoms; Alk is an alkylene group containing up to 10 carbon atoms.

The amide can be derived from a monocarboxylic acid, a hydrocarbyl group containing from 6 to 30 or 38 carbon atoms and more often will be a hydrocarbyl group derived from a fatty acid containing from 12 to 24 carbon atoms.

The amide is derived from a di- or tricarboxylic acid, will contain from 6 to 90 or more carbon atoms depending on the type of polycarboxylic acid. For example, when the amide is derived from a dimer acid, will contain from 18 to 44 carbon atoms or more, and amides derived from trimer acids generally will contain an average of from 44 to 90 carbon atoms. Each is independently hydrogen or a hydrocarbyl, aminohydrocarbyl, hydroxyhydrocarbyl or a heterocyclic-substituted hydrocarbon group containing up to 10 carbon atoms. It may be independently heterocyclic substituted hydrocarbyl groups wherein the heterocyclic substituent is derived from pyrrole, pyrroline, pyrrolidine, morpholine, piperazine, piperidine, pyridine, pipecoline, etc. Specific examples include methyl, ethyl, n-propyl, n-butyl, n-hexyl, hydroxymethyl, hydroxyethyl, hydroxypropyl, amino-methyl, aminoethyl, aminopropyl, 2-ethylpyridine, 1-ethylpyrrolidine, 1-ethylpiperidine, etc.

The alkyl group can be an alkylene group containing from 1 to 10 carbon atoms. Examples of such alkylene groups include methylene, ethylene, propylene, etc. Also are hydrocarbylene groups, and in particular, alkylene group containing up to 10 carbon atoms. Examples of such hydrocarbylene groups include, methylene, ethylene, propylene, etc. The amide contains at least one morpholinyl group. In one embodiment, the morpholine structure is formed as a result of the condensation of two hydroxy groups which are attached to the hydrocarbylene groups. Typically, the amides are prepared by reacting a carboxylic acid or reactive derivative thereof with an amine which contains at least one >NH group.

Aliphatic monoamines include mono-aliphatic and di-aliphatic-substituted amines wherein the aliphatic groups may be saturated or unsaturated and straight chain or branched chain. Such amines include, for example, mono- and di-alkyl-substituted amines, mono- and dialkenyl-substituted amines, etc. Specific examples of such monoamines include ethyl amine, diethyl amine, n-butyl amine, di-n-butyl amine, isobutyl amine, coco amine, stearyl amine, oleyl amine, etc. An example of a cycloaliphatic-substituted aliphatic amine is 2-(cyclohexyl)-ethyl amine. Examples of heterocyclic-substituted aliphatic amines include 2-(2-aminoethyl)-pyrrole, 2-(2-aminoethyl)-1-methyl pyrrole, 2-(2-aminoethyl)-1-methylpyrrolidine and 4-(2-aminoethyl)morpholine, 1-(2-aminoethyl)piperazine, 1-(2-aminoethyl)piperidine, 2-(2-aminoethyl)pyridine, 1-(2-aminoethyl)pyrrolidine, 1-(3-aminopropyl)imidazole, 3-(2-aminopropyl)indole, 4-(3-aminopropyl)morpholine, 1-(3-aminopropyl)-2-pipecoline, 1-(3-aminopropyl)-2-pyrrolidinone, etc.

Cycloaliphatic monoamines are those monoamines wherein there is one cycloaliphatic substituent attached directly to the amino nitrogen through a carbon atom in the cyclic ring structure. Examples of cycloaliphatic monoamines include cyclohexylamines, cyclopentylamines, cyclohexenylamines, cyclopentenylamines, N-ethyl-cyclohexylamine, dicyclohexylamines, and the like. Examples of aliphatic-substituted, aromatic-substituted, and heterocyclic-substituted cycloaliphatic monoamines include propyl-substituted cyclohexylamines, phenyl-substituted cyclopentylamines, and pyranyl-substituted cyclohexylamine.

Aromatic amines include those monoamines wherein a carbon atom of the aromatic ring structure is attached directly to the amino nitrogen. The aromatic ring will usually be a mononuclear aromatic ring (i.e., one derived from benzene) but can include fused aromatic rings, especially those derived from naphthalene. Examples of aromatic monoamines include aniline, di-(para-methylphenyl)amine, naphthylamine, N-(n-butyl)-aniline, and the like. Examples of aliphatic-substituted, cycloaliphatic-substituted, and heterocyclic-substituted aromatic monoamines are para-ethoxyaniline, para-dodecylaniline, cyclohexyl-substituted naphthylamine, variously substituted phenathiazines, and thienyl-substituted aniline.

Polyamines are aliphatic, cycloaliphatic and aromatic polyamines analogous to the above-described monoamines except for the presence within their structure of additional amino nitrogens. The additional amino nitrogens can be primary, secondary or tertiary amino nitrogens. Examples of such polyamines include N-amino-propyl-cyclohexylamines, N,N'-di-n-butyl-paraphenylene diamine, bis-(para-aminophenyl)methane, 1,4-diaminocyclohexane, and the like.

The hydroxyl-substituted amines contemplated are those having hydroxy substituents bonded directly to a carbon atom other than a carbonyl carbon atom; that is, they have hydroxy groups capable of functioning as alcohols. Examples of such hydroxy-substituted amines include ethanolamine, di-(3-hydroxypropyl)-amine, 3-hydroxybutyl-amine, 4-hydroxybutyl-amine, diethanolamine, di-(2-hydroxyamine, N-(hydroxypropyl)-propylamine, N-(2-methyl)-cyclohexylamine, 3-hydroxycyclopentyl parahydroxyaniline, N-hydroxyethal piperazine and the like.

In one embodiment, the amines useful in the present invention are alkylene polyamines including hydrogen, or a hydrocarbyl, amino hydrocarbyl, hydroxyhydrocarbyl or heterocyclic-substituted hydrocarbyl group containing up to 10 carbon atoms, Alk is an alkylene group containing up to 10 carbon atoms, and is 2 to 10. Preferably, Alk is ethylene or propylene. Usually, a will have an average value of from 2 to 7. Examples of such alkylene polyamines include methylene polyamines, ethylene polyamines, butylene polyamines, propylene polyamines, pentylene polyamines, hexylene polyamines, heptylene polyamines, etc.

Alkylene polyamines include ethylene diamine, triethylene tetramine, propylene diamine, trimethylene diamine, hexamethylene diamine, decamethylene diamine, hexamethylene diamine, decamethylene diamine, octamethylene diamine, di(heptamethylene)triamine, tripropylene tetramine, tetraethylene pentamine, trimethylene diamine, pentaethylene hexamine, di(trimethylene)triamine, and the like. Higher homologs as are obtained by condensing two or more of the above-illustrated alkylene amines are useful, as are mixtures of two or more of any of the afore-described polyamines.

Ethylene polyamines, such as those mentioned above, are especially useful for reasons of cost and effectiveness. Such polyamines are described in detail under the heading "Diamines and Higher Amines" in The Encyclopedia of Chemical Technology, Second Edition, Kirk and Othmer, Volume 7, pages 27-39, Interscience Publishers, Division of John Wiley and Sons, 1965, which is hereby incorporated by reference for the disclosure of useful polyamines. Such compounds are prepared most conveniently by the reaction of an alkylene chloride with ammonia or by reaction of an ethylene imine with a ring-opening reagent such as ammonia, etc. These reactions result in the production of the somewhat complex mixtures of alkylene polyamines, including cyclic condensation products such as piperazines.

Other useful types of polyamine mixtures are those resulting from stripping of the above-described polyamine mixtures. In this instance, lower molecular weight polyamines and volatile contaminants are removed from an alkylene polyamine mixture to leave as residue what is often termed "polyamine bottoms". In general, alkylene polyamine bottoms can be characterized as having less than 2, usually less than 1% (by weight) material boiling below 200° C. In the instance of ethylene polyamine bottoms, which are readily available and found to be quite useful, the bottoms contain less than 2% (by weight) total diethylene triamine (DETA) or triethylene tetramine (TETA). A typical sample of such ethylene polyamine bottoms obtained from the Dow Chemical Company of Freeport, Tex. designated "E-100". Gas chromatography analysis of such a sample showed it to contain 0.93% "Light Ends" (most probably DETA), 0.72% TETA, 21.74% tetraethylene pentamine and 76.61% pentaethylene hexamine and higher (by weight). These alkylene polyamine bottoms include cyclic condensation products such as piperazine and higher analogs of diethylene triamine, triethylene tetramine and the like.

The dispersants are selected from: Mannich bases that are condensation reaction products of a high molecular weight phenol, an alkylene polyamine and an aldehyde such as formaldehyde, succinic-based dispersants that are reaction products of a olefin polymer and succinic acylating agent (acid, anhydride, ester or halide) further reacted with an organic hydroxy compound and/or an amine, high molecular weight amides and esters such as reaction products of a hydrocarbyl acylating agent and a polyhydric aliphatic alcohol (such as glycerol, pentaerythritol or sorbitol). Ashless (metal-free) polymeric materials that usually contain an oil soluble high molecular weight backbone linked to a polar functional group that associates with particles to be dispersed are typically used as dispersants. Zinc acetate capped, also any treated dispersant, which include borated, cyclic carbonate, end-capped, polyalkylene maleic anhydride and the like; mixtures of some of the above, in treat rates that range from 0.1% up to 10-20% or more. Commonly used hydrocarbon backbone materials are olefin polymers and copolymers, i.e. ethylene, propylene, butylene, isobutylene, styrene; there may or may not be further functional groups incorporated into the backbone of the polymer, whose molecular weight ranges from 300 to 5000. Polar materials such as amines, alcohols, amides or esters are attached to the backbone via a bridge.

B. Antioxidants

Antioxidants include sterically hindered alkyl phenols such as 2,6-di-tert-butylphenol, 2,6-di-tert-butyl-p-cresol and 2,6-di-tert-butyl-4-(2-octyl-3-propanoic)phenol; N,N-di (alkylphenyl)amines; and alkylated phenylenediamines.

The antioxidant component may be a hindered phenolic antioxidant such as butylated hydroxytoluene, suitably present in an amount of 0.01 to 5%, preferably 0.4 to 0.8%, by weight of the lubricant composition. Alternatively, or in addition, component b) may comprise an aromatic amine antioxidant such as mono-octylphenylalphanapthylamine or p,p-dioctyldiphenylamine, used singly or in admixture. The amine anti-oxidant component is suitably present in a range of from 0.01 to 5% by weight of the lubricant composition, more preferably 0.5 to 1.5%.

A sulfur-containing antioxidant may be any and every antioxidant containing sulfur, for example, including dialkyl thiodipropionates such as dilauryl thiodipropionate and distearyl thiodipropionate, dialkyldithiocarbamic acid derivatives (excluding metal salts), bis(3,5-di-t-butyl-4-hydroxybenzyl)sulfide, mercaptobenzothiazole, reaction products of phosphorus pentoxide and olefins, and dicetyl sulfide. Of these, preferred are dialkyl thiodipropionates such as dilauryl thiodipropionate and distearyl thiodipropionate.

The amine-type antioxidant includes, for example, monoalkyldiphenylamines such as monooctyldiphenylamine and monononyldiphenylamine; dialkyldiphenylamines such as 4,4'-dibutyldiphenylamine, 4,4'-dipentyldiphenylamine, 4,4'-dihexyldiphenylamine, 4,4'-diheptyldiphenylamine, 4,4'-dioctyldiphenylamine and 4,4'-dinonyldiphenylamine; polyalkyldiphenylamines such as tetrabutyldiphenylamine, tetrahexyldiphenylamine, tetraoctyldiphenylamine and tetranonyldiphenylamine; and naphthylamines such as alpha-naphthylamine, phenyl-alpha-naphthylamine, butylphenyl-alpha-naphthylamine, pentylphenyl-alpha-naphthyl amine, hexylphenyl-alpha-naphthylamine, heptylphenyl-alpha-naphthylamine, octylphenyl-alpha-naphthylamine and nonylphenyl-alpha-naphthylamine. Of these, preferred are dialkyldiphenylamines. The sulfur-containing antioxidant and the amine-type antioxidant are added to the base oil in an amount of from 0.01 to 5% by weight, preferably from 0.03 to 3% by weight, relative to the total weight of the composition.

The oxidation inhibitors that are particularly useful in lube compositions of the invention are the hindered phenols (e.g., 2,6-di-(t-butyl)phenol); aromatic amines (e.g., alkylated diphenyl amines); alkyl polysulfides; selenides; borates (e.g., epoxide/boric acid reaction products); phosphorodithioic acids, esters and/or salts; and the dithiocarbamate (e.g., zinc dithiocarbamates). These oxidation inhibitors as well as the oxidation inhibitors discussed above the preferably of the invention at levels of 0.05% to 5%, more preferably 0.25 to 2% by weight based on the total weight of such compositions; with ratios of amine/phenolic to be from 1:10 to 10:1 of the mixtures preferred.

The oxidation inhibitors that are also useful in lube compositions of the invention are chlorinated aliphatic hydrocarbons such as chlorinated wax; organic sulfides and polysulfides such as benzyl disulfide, bis(chlorobenzyl)disulfide, dibutyl tetrasulfide, sulfurized methyl ester of oleic acid, sulfurized alkylphenol, sulfurized dipentene, and sulfurized terpene; phosphosulfurized hydrocarbons such as the reaction product of a phosphorus sulfide with turpentine or methyl oleate, phosphorus esters including principally dihydrocarbon and trihydrocarbon phosphites such as dibutyl phosphite, diheptyl phosphite, dicyclohexyl phosphite, pentylphenyl phosphite, dipentylphenyl phosphite, tridecyl phosphite, distearyl phosphite, dimethyl naphthyl phosphite, oleyl 4-pentylphenyl phosphite, polypropylene (molecular weight 500)-substituted phenyl phosphite, diisobutyl-substituted phenyl phosphite; metal thiocarbamates, such as zinc dioctyldithiocarbamate, and barium heptylphenyl dithiocarbamate; Group II metal phosphorodithioates such as zinc dicyclohexylphosphorodithioate, zinc dioctylphosphorodithioate, barium di(heptylphenyl)(phosphorodithioate, cadmium dinonylphosphorodithioate, and the reaction of phosphorus pentasulfide with an equimolar mixture of isopropyl alcohol, 4-methyl-2-pentanol, and n-hexyl alcohol.

Oxidation inhibitors, organic compounds containing sulfur, nitrogen, phosphorus and some alkylphenols are also employed. Two general types of oxidation inhibitors are those that react with the initiators, peroxy radicals, and hydroperoxides to form inactive compounds, and those that decompose these materials to form less active compounds. Examples are hindered (alkylated) phenols, e.g. 6-di(tert-butyl)-4-methylphenol[2,6-di(tert-butyl)-p-cresol, DBPC], and aromatic amines, e.g. N-phenyl-alpha-naphthalamine. These are used in turbine, circulation, and hydraulic oils that are intended for extended service.

Examples of amine-based antioxidants include dialkyldiphenylamines such as p,p'-dioctyldiphenylamine (manufactured by the Seiko Kagaku Co. under the trade designation "Nonflex OD-3"), p,p'-di-alphamethylbenzyl-diphenylamine and N-p-butylphenyl-N-p'-octylphenylamine; monoalkyldiphenylamines such as mono-t-butyldiphenylamine, and monooctyldiphenylamine; bis(dialkylphenyl)amines such as di(2,4-diethylphenyl)amine and di(2-ethyl-4-nonylphenyl) amine; alkylphenyl-1-naphthylamines such as octylphenyl-1-naphthylamine and N-t-dodecylphenyl-1-naphthylamine; arylnaphthylamines such as 1-naphthylamine, phenyl-1-naphthylamine, phenyl-2-naphthylamine, N-hexylphenyl-2-naphthylamine and N-octylphenyl-2-naphthylamine, phenylenediamines such as N,N'-diisopropyl-p-phenylenediamine and N,N'-diphenyl-p-phenylenediamine, and phenothiazines such as phenothiazine (manufactured by the Hodogaya Kagaku Co.: Phenothiazine) and 3,7-dioctylphenothiazine.

Examples of sulfur-based antioxidants include dialkylsulphides such as didodecylsulphide and dioctadecylsulphide; thiodipropionic acid esters such as didodecyl thiodipropionate, dioctadecyl thiodipropionate, dimyristyl thiodipropionate and dodecyloctadecyl thiodipropionate, and 2-mercaptobenzimidazole.

Examples of phenol-based antioxidants include 2-t-butylphenol, 2-t-butyl-4-methylphenol, 2-t-butyl-5-methylphenol, 2,4-di-t-butylphenol, 2,4-dimethyl-6-t-butylphenol, 2-t-butyl-4-methoxyphenol, 3-t-butyl-4-methoxyphenol, 2,5-di-t-butylhydroquinone (manufactured by the Kawaguchi Kagaku Co. under trade designation "Antage DBH"), 2,6-di-t-butylphenol and 2,6-di-t-butyl-4-alkylphenols such as 2,6-di-t-butyl-4-methylphenol and 2,6-di-t-butyl-4-ethylphenol; 2,6-di-t-butyl-4-alkoxyphenols such as 2,6-di-t-butyl-4-methoxyphenol and 2,6-di-t-butyl-4-ethoxyphenol, 3,5-di-t-butyl-4-hydroxybenzylmercaptoocty-1-acetate, alkyl-3-(3,5-di-t-butyl-4-hydroxyphenyl)propionates such as n-octyl-3-(3,5-di-t-butyl-4-hydroxyphenyl)propionate (manufactured by the Yoshitomi Seiyaku Co. under the trade designation "Yonox SS"), n-dodecyl-3-(3,5-di-t-butyl-4-hydroxyphenyl) propionate and 2'-ethylhexyl-3-(3,5-di-t-butyl-4-hydroxyphenyl)propionate; 2,6-di-t-butyl-alpha-dimethylamino-p-cresol, 2,2'-methylenebis(4-alkyl-6-t-butylphenol) compounds such as 2,2'-methylenebis(4-methyl-6-t-butylphe-nol) (manufactured by the Kawaguchi Kagaku Co. under the trade designation "Antage W-400") and 2,2'-methylenebis(4-ethyl-6-t-butylphenol) (manufactured by the Kawaguchi Kagaku Co. under the trade designation "Antage W-500"); bisphenols such as 4,4'-butylidenebis(3-methyl-6-t-butyl-phenol) (manufactured by the Kawaguchi Kagaku Co. under the trade designation "Antage W-300"), 4,4'-methylenebis(2,6-di-t-butylphenol) (manufactured by Laporte Performance Chemicals under the trade designation "Ionox 220AH"), 4,4'-bis(2,6-di-t-butylphenol), 2,2-(di-p-hydroxyphenyl)propane (Bisphenol A), 2,2-bis(3,5-di-t-butyl-4-hydroxyphenyl)propane, 4,4'-cyclohexylidenebis(2,6-di-t-butylphenol), hexamethylene glycol bis[3, (3,5-di-t-butyl-4-hydroxyphenyl)propionate] (manufactured by the Ciba Speciality Chemicals Co. under the trade designation "Irganox L109"), triethylene glycol bis[3-(3-t-butyl-4-hydroxy-5-methylphenyl)propionate] (manufactured by the Yoshitomi Seiyaku Co. under the trade designation "Tominox 917"), 2,2'-thio[diethyl-3-(3,5-di-t-butyl-4-hydroxyphenyl)propionate] (manufactured by the Ciba Speciality Chemicals Co. under the trade designation "Irganox L115"), 3,9-bis{1,1-dimethyl-2-[3-(3-t-butyl-4-hydroxy-5-methylphenyl)-propionyloxy]ethyl}2,4,8,10-tetraoxaspiro[5,5]undecane (manufactured by the Sumitomo Kagaku Co. under the trade designation "Sumilizer GA80") and 4,4'-thiobis(3-methyl-6-t-butylphenol) (manufactured by the Kawaguchi Kagaku Co. under the trade designation "Antage RC"), 2,2'-thiobis(4,6-di-t-butylresorcinol); polyphenols such as tetrakis[methylene-3-(3,5-di-t-butyl-4-hydroxyphenyl)propionato]methane (manufactured by the Ciba Speciality Chemicals Co. under the trade designation "Irganox L101"), 1,1,3-tris(2-methyl-4-hydroxy-5-t-butylpheny-1)butane (manufactured by the Yoshitomi Seiyaku Co. under the trade designation "Yoshinox 930"), 1,3,5-trimethyl-2,4,6-tris(3,5-di-t-butyl-4-hydroxybenzyl)benzene (manufactured by Ciba Speciality Chemicals under the trade designation "Irganox 330"), bis[3,3'-bis(4'-hydroxy-3'-t-butylpheny-1)butyric acid]glycol ester, 2-(3',5'-di-t-butyl-4-hydroxyphenyl)-methyl-4-(2",4"-di-t-butyl-3"-hydroxyphenyl)methyl-6-t-butylphenol and 2,6-bis(2'-hydroxy-3'-t-butyl-5'-methylbenzyl)-4-methylphenol; and phenol/aldehyde condensates such as the condensates of p-t-butylphenol and formaldehyde and the condensates of p-t-butylphenol and acetaldehyde.

C. VI Improvers and Pour Point Depressants:

Viscosity index improvers and/or the pour point depressant include polymeric alkylmethacrylates and olefinic copolymers such as an ethylene-propylene copolymer or a styrene-butadiene copolymer or polyalkene such as PIB. Viscosity index improvers (VI improvers), high molecular weight polymers that increase the relative viscosity of an oil at high temperatures more than they do at low temperatures. The most common VI improvers are methacrylate polymers and copolymers, acrylate polymers, olefin polymers and copolymers, and styrene-butadiene copolymers.

Other examples of the viscosity index improver include polymethacrylate, polyisobutylene, alpha-olefin polymers, alpha-olefin copolymers (e.g., an ethylene-propylene copolymer), polyalkylstyrene, phenol condensates, naphthalene condensates, a styrenebutadiene copolymer and the like. Of these, polymethacrylate having a number average molecular weight of 10,000 to 300,000, and alpha-olefin polymers or alpha-olefin copolymers having a number average molecular weight of 1,000 to 30,000, particularly ethylene-alpha-olefin copolymers having a number average molecular weight of 1,000 to 10,000 are preferred.

The viscosity index increasing agents which can be used include, for example, polymethacrylates and ethylene/propylene copolymers, other non-dispersion type viscosity index increasing agents such as olefin copolymers like styrene/diene copolymers, and dispersible type viscosity index increasing agents where a nitrogen containing monomer has been copolymerized in such materials. These materials can be added and used individually or in the form of mixtures, conveniently in an amount within the range of from 0.05 to 20 parts by weight per 100 parts by weight of base oil.

Pour point depressors (PPD) include polymethacrylates. Commonly used additives such as alkylaromatic polymers and polymethacrylates are useful for this purpose; typically the treat rates range from 0.001% to 1.0%.

D. Detergents:

Detergents include calcium alkylsalicylates, calcium alkylphenates and calcium alkarylsulfonates with alternate metal ions used such as magnesium, barium, or sodium. Examples of the cleaning and dispersing agents which can be used include metal-based detergents such as the neutral and basic alkaline earth metal sulphonates, alkaline earth metal phenates and alkaline earth metal salicylates alkenylsuccinimide and alkenylsuccinimide esters and their borohydrides, phenates, salienius complex detergents and ashless dispersing agents which have been modified with sulfur compounds. These agents can be added and used individually or in the form of mixtures, conveniently in an amount within the range of from 0.01 to 1 part by weight per 100 parts by weight of base oil; these can also be high TBN, low TBN, or mixtures of high/low TBN.

E. Anti-Rust Additives:

Anti-rust additives include (short-chain) alkenyl succinic acids, partial esters thereof and nitrogen-containing derivatives thereof; and synthetic alkarylsulfonates, such as metal dinonylnaphthalene sulfonates. Anti-rust agents include, for example, monocarboxylic acids which have from 8 to 30 carbon atoms, alkyl or alkenyl succinates or partial esters thereof, hydroxy-fatty acids which have from 12 to 30 carbon atoms and derivatives thereof, sarcosines which have from 8 to 24 carbon atoms and derivatives thereof, amino acids and derivatives thereof, naphthenic acid and derivatives thereof, lanolin fatty acid, mercapto-fatty acids and paraffin oxides.

Particularly preferred anti-rust agents are indicated below. Examples of Monocarboxylic Acids ($C_8$-$C_{30}$), Caprylic acid, pelargonic acid, decanoic acid, undecanoic acid, lauric acid, myristic acid, palmitic acid, stearic acid, arachic acid, behenic acid, cerotic acid, montanic acid, melissic acid, oleic acid, docosanic acid, erucic acid, eicosenic acid, beef tallow fatty acid, soy bean fatty acid, coconut oil fatty acid, linolic acid, linoleic acid, tall oil fatty acid, 12-hydroxystearic acid, laurylsarcosinic acid, myritsylsarcosinic acid, palmitylsarcosinic acid, stearylsarcosinic acid, oleylsarcosinic acid, alkylated ($C_8$-$C_{20}$) phenoxyacetic acids, lanolin fatty acid and $C_8$-$C_{24}$ mercapto-fatty acids.

Examples of Polybasic Carboxylic Acids: The alkenyl ($C_{10}$-$C_{100}$) succinic acids indicated in CAS No. 27859-58-1 and ester derivatives thereof, dimer acid, N-acyl-N-alkyloxyalkyl aspartic acid esters (U.S. Pat. No. 5,275,749). Examples of the alkylamines which function as antirust additives or as reaction products with the above carboxylates to give amides and the like are represented by primary amines such as laurylamine, coconut-amine, n-tridecylamine, myristylamine, n-pentadecylamine, palmitylamine, n-heptadecylamine, stearylamine, n-nonadecylamine, n-eicosylamine, n-heneicosylamine, n-docosylamine, n-tricosylamine, n-pentacosylamine, oleylamine, beef tallow-amine, hydrogenated beef tallow-amine and soy bean-amine. Examples of the secondary amines include dilaurylamine, di-coconut-amine, di-n-tridecylamine, dimyristylamine, di-n-pentadecylamine, dipalmitylamine, di-n-pentadecylamine, distearylamine, di-n-nonadecylamine, di-n-eicosylamine, di-n-heneicosylamine, di-n-docosylamine, di-n-tricosylamine, di-n-pentacosyl-amine, dioleylamine, di-beef tallow-amine, di-hydrogenated beef tallow-amine and di-soy bean-amine Examples of the aforementioned N-alkylpolyalkyenediamines include: ethylenediamines such as laurylethylenediamine, coconut ethylenediamine, n-tridecylethylenediamine, myristylethylenediamine, n-pentadecylethylenediamine, palmitylethylenediamine, n-heptadecylethylenediamine, stearylethylenediamine, n-nonadecylethylenediamine, n-eicosylethylenediamine, n-heneicosylethylenediamine, n-docosylethylendiamine, n-tricosylethylenediamine, n-pentacosylethylenediamine, oleylethylenediamine, beef tallow-ethylenediamine, hydrogenated beef tallow-ethylenediamine and soy bean-ethylenediamine; propylenediamines such as laurylpropylenediamine, coconut propylenediamine, n-tridecylpropylenediamine, myristylpropylenediamine, n-pentadecylpropylenediamine, palmitylpropylenediamine, n-heptadecylpropylenediamine, stearylpropylenediamine, n-nonadecylpropylenediamine, n-eicosylpropylenediamine, n-heneicosylpropylenediamine, n-docosylpropylendiamine, n-tricosylpropylenediamine, n-pentacosylpropylenediamine, diethylene triamine (DETA) or triethylene tetramine (TETA), oleylpropylenediamine, beef tallow-propylenediamine, hydrogenated beef tallow-propylenediamine and soy bean-propylenediamine; butylenediamines such as laurylbutylenediamine, coconut butylenediamine, n-tridecylbutylenediamine-, myristylbutylenediamine, n-pentadecylbutylenediamine, stearylbutylenediamine, n-eicosylbutylenediamine, n-heneicosylbutylenediamine, n-docosylbutylendiamine, n-tricosylbutylenediamine, n-pentacosylbutylenediamine, oleylbutylenediamine, beef tallow-butylenediamine, hydrogenated beef tallow-butylenediamine and soy bean butylenediamine; and pentylenediamines such as laurylpentylenediamine, coconut pentylenediamine, myristylpentylenediamine, palmitylpentylenediamine, stearylpentylenediamine, oleylpentylenediamine, beef tallow-pentylenediamine, hydrogenated beef tallow-pentylenediamine and soy bean pentylenediamine.

F. Demulsifying Agents

Demulsifying agents include alkoxylated phenols and phenol-formaldehyde resins and synthetic alkylaryl sulfonates such as metallic dinonylnaphthalene sulfonates. A demulsifing agent is a predominant amount of a water-soluble polyoxyalkylene glycol having a pre-selected molecular weight of any value in the range of between 450 and 5000 or more. An especially preferred family of water soluble polyoxyalkylene glycol useful in the compositions of the present invention may also be one produced from alkoxylation of n-butanol with a mixture of alkylene oxides to form a random alkoxylated product.

Functional fluids according to the invention possess a pour point of less than −20° C., and exhibit compatibility with a wide range of anti-wear additive and extreme pressure additives. The formulations according to the invention also are devoid of fatigue failure that is normally expected by those of ordinary skill in the art when dealing with polar lubricant base stocks.

Polyoxyalkylene glycols useful in the present invention may be produced by a well-known process for preparing polyalkylene oxide having hydroxyl end-groups by subjecting an alcohol or a glycol ether and one or more alkylene oxide monomers such as ethylene oxide, butylene oxide, or propylene oxide to form block copolymers in addition polymerization while employing a strong base such as potassium hydroxide as a catalyst. In such process, the polymerization is commonly carried out under a catalytic concentration of 0.3 to 1.0% by mole of potassium hydroxide to the monomer(s) and at high temperature, as 100° C. to 160° C. It is well known fact that the potassium hydroxide being a catalyst is for the most part bonded to the chain-end of the produced polyalkylene oxide in a form of alkoxide in the polymer solution so obtained.

An especially preferred family of soluble polyoxyalkylene glycol useful in the compositions of the present invention may also be one produced from alkoxylation of n-butanol with a mixture of alkylene oxides to form a random alkoxylated product.

F. Foam Inhibitors

Foam inhibitors (defoamants or defoamers) include polymers of alkyl methacrylate especially useful poly alkyl acrylate polymers where alkyl is generally understood to be methyl, ethyl propyl, isopropyl, butyl, or iso butyl and polymers of dimethylsilicone which form materials called dimethylsiloxane polymers in the viscosity range of 100 cSt to 100,000 cSt. Other additives are defoamers, such as silicone polymers which have been post reacted with various carbon containing moieties, are the most widely used defoamers. Organic polymers are sometimes used as defoamers although much higher concentrations are required.

G. Metal Deactivating Compounds and Corrosion Inhibitors

Metal deactivating compounds/corrosion inhibitors include 2,5-dimercapto-1,3,4-thiadiazoles and derivatives thereof, mercaptobenzothiazoles, alkyltriazoles and benzotriazoles. Examples of dibasic acids useful as anti-corrosion agents, other than sebacic acids, which may be used in the present invention, are adipic acid, azelaic acid, dodecanedioic acid, 3-methyladipic acid, 3-nitrophthalic acid, 1,10-decanedicarboxylic acid, and fumaric acid. The anti-corrosion combination is a straight or branch-chained, saturated or unsaturated monocarboxylic acid or ester thereof which may optionally be sulfurized in an amount up to 35% by weight. Preferably the acid is a $C_4$ to $C_{22}$ straight chain unsaturated monocarboxylic acid. The preferred concentration of this additive is from 0.001% to 0.35% by weight of the total lubricant composition. The preferred monocarboxylic acid is sulfurized oleic acid. However, other suitable materials are oleic acid itself; valeric acid and erucic acid. A component of the anti-corrosion combination is a triazole as previously defined. The triazole should be used at a concentration from 0.005% to 0.25% by weight of the total composition. The preferred triazole is tolylotriazole which may be included in the compositions of the invention include triazoles, thiazoles and certain diamine compounds which are useful as metal deactivators or metal passivators. Examples include triazole, benzotriazole and substituted benzotriazoles such as alkyl substituted derivatives. The alkyl substituent generally contains up to 1.5 carbon atoms, preferably up to 8 carbon atoms. The triazoles may contain other substituents on the aromatic ring such as halogens, nitro, amino, mercapto, etc. Examples of suitable compounds are benzotriazole and the tolyltriazoles, ethylbenzotriazoles, hexylbenzotriazoles, octylbenzotriazoles, chlorobenzotriazoles and nitrobenzotriazoles. Benzotriazole and tolyltriazole are particularly preferred. A straight or branched chain saturated or unsaturated monocarboxylic acid which is optionally sulfurized in an amount which may be up to 35% by weight; or an ester of such an acid; and a triazole or alkyl derivatives thereof, or short chain alkyl of up to 5 carbon atoms; n is zero or an integer between 1 and 3 inclusive; and is hydrogen, morpholino, alkyl, amido, amino, hydroxy or alkyl or aryl substituted derivatives thereof; or a triazole selected from 1,2,4 triazole, 1,2,3 triazole, 5-anilo-1,2,3,4-thiatriazole, 3-amino-1,2,4-triazole, 1-H-benzotriazole-1-yl-methylisocyanide, methylene-bis-benzotriazole and naphthotriazole.

Alkyl is straight or branched chain and is for example methyl, ethyl, n-propyl, iso-propyl, n-butyl, sec-butyl, n-pentyl, n-hexyl, n-heptyl, n-octyl, 2-ethylhexyl, n-nonyl, n-decyl, n-dodecyl, n-tetradecyl, n-hexadecyl, n-octadecyl or n-eicosyl.

Alkenyl is straight or branched chain and is for example prop-2-enyl, but-2-enyl, 2-methyl-prop-2-enyl, pent-2-enyl, hexa-2,4-dienyl, dec-10-enyl or eicos-2-enyl.

Cylcoalkyl is for example cyclopentyl, cyclohexyl, cyclooctyl, cyclodecyl, adamantyl or cyclododecyl.

Aralkyl is for example benzyl, 2-phenylethyl, benzhydryl or naphthylmethyl. Aryl is for example phenyl or naphthyl.

The heterocyclic group is for example a morpholine, pyrrolidine, piperidine or a perhydroazepine ring.

Alkylene moieties include for example methylene, ethylene, 1:2- or 1:3-propylene, 1:4-butylene, 1:6-hexylene, 1:8-octylene, 1:10-decylene and 1:12-dodecylene.

Arylene moieties include for example phenylene and naphthylene. 1-(or 4)-(dimethylaminomethyl)triazole, 1-(or 4)-(diethylaminomethyl)triazole, 1-(or 4)-(di-isopropylaminomethyl)triazole, 1-(or 4)-(di-n-butylaminomethyl)triazole, 1-(or 4)-(di-n-hexylaminomethyl)triazole, 1-(or 4)-(di-isooctylaminomethyl)triazole, 1-(or 4)-(di-(2-ethylhexyl)aminomethyl)triazole, 1-(or 4)-(di-n-decylaminomethyl)triazole, 1-(or 4)-(di-n-dodecylaminomethyl)triazole, 1-(or 4)-(di-n-octadecylaminomethyl)triazole, 1-(or 4)-(di-n-eicosylaminomethyl)triazole, 1-(or 4)-[di-(prop-2'-enyl) aminomethyl]triazole, 1-(or 4)-[di-(but-2'-enyl) aminomethyl]triazole, 1-(or 4)-[di-(eicos-2'-enyl) aminomethyl]triazole, 1-(or 4)-(di-cyclohexylaminomethyl) triazole, 1-(or 4)-(di-benzylaminomethyl)triazole, 1-(or 4)-(di-phenylaminomethyl)triazole, 1-(or 4)-(4'-morpholinomethyl)triazole, 1-(or 4)-(1'-pyrrolidinomethyl) triazole, 1-(or 4)-(1'-piperidinomethyl)triazole, 1-(or 4)-(1'-perhydroroazepinomethyl)triazole, 1-(or 4)-(2',2"-dihydroxyethyl)aminomethyl]triazole, 1-(or 4)-(dibutoxypropyl-aminomethyl)triazole, 1-(or 4)-(dibutylthiopropyl-aminomethyl)triazole, 1-(or 4)-(dibutylaminopropyl-aminomethyl)triazole, 1-(or 4)-(1-methanomine)-N,N-bis(2-ethylhexyl)-methyl benzotriazole, N,N-bis-(1- or 4-triazolylmethyl)laurylamine, N,N-bis-(1- or 4-triazolylmethyl)oleylamine, N,N-bis-(1- or 4-triazolylmethyl)ethanolamine and N,N,N',N'-tetra(1- or 4-triazolylmethyl)ethylene diamine.

Also, dihydrocarbyl dithiophosphate metal salts where the metal is aluminum, lead, tin, manganese, molybedenum, antimony, cobalt, nickel, zinc or copper, but most often zinc. Sulfur- and/or phosphorus- and/or halogen-containing compounds, such as sulfurized olefins and vegetable oils, tritolyl phosphate, tricresyl phosphate, chlorinated paraffins, alkyl and aryl di- and trisulfides, amine salts of mono- and dialkyl phosphates, amine salts of methylphosphonic acid, diethanolaminomethyltolyltriazole, di(2-ethylhexyl)-aminomethyltolyltriazole, derivatives of 2,5-dimercapto-1,3,4-thiadiazole, ethyl((bisisopropyloxyphosphinothioyl)-thio) propionate, triphenyl thiophosphate (triphenyl phosphorothioate), tris(alkylphenyl)phosphorothioates and mixtures thereof (for example tris(isononylphenyl)phosphorothioate), diphenylmonononylphenyl phosphorothioate, isobutylphenyl diphenyl phosphorothioate, the dodecylamine salt of 3-hydroxy-1,3-thiaphosphetan 3-oxide, trithiophosphoric acid 5,5,5-tris(isooctyl 2-acetate), derivatives of 2-mercaptobenzothiazole, such as 1-(N,N-bis(2-ethylhexyl) aminomethyl)-2-mercapto-1H-1,3-benzothiazole or ethoxycarbonyl 5-octyldithiocarbamate.

The metal deactivating agents which can be used in the lubricating oil a composition of the present invention include benzotriazole and the 4-alkylbenzotriazoles such as 4-methylbenzotriazole and 4-ethylbenzotriazole; 5-alkylbenzotriazoles such as 5-methylbenzotriazole, 5-ethylbenzotriazole; 1-alkylbenzotriazoles such as 1-dioctylauainomethyl-2,3-benzotriazole; benzotriazole derivatives such as the 1-alkyltolutriazoles, for example, 1-dioctylaminomethyl-2,3-tolutriazole; benzimidazole and benzimidazole derivatives such as 2-(alkyldithio)-benzimidazoles, for example, such as 2-(octyldithio)-benzimidazole, 2-(decyldithio)benzimidazole and 2-(dodecyldithio)-benzimidazole; 2-(alkyldithio)-toluimidazoles such as 2-(octyldithio)-toluimidazole, 2-(decyldithio)-toluimidazole and 2-(dodecyldithio)-toluimidazole; indazole and indazole derivatives of toluimidazoles such as 4-alkylindazole, 5-alkylindazole; benzothiazole, 2-mercaptobenzothiazole derivatives (manufactured by the Chiyoda Kagaku Co. under the trade designation "Thiolite B-3100") and 2-(alkyldithio)benzothiazoles such as 2-(hexyldithio)benzothiazole and 2-(octyldithio)benzothiazole; 2-(alkyl-dithio)toluthiazoles such as 2-(benzyldithio)toluthiazole and 2-(octyldithio)toluthiazole, 2-(N,N-dialkyldithiocarbamyl)benzothiazoles such as 2-(N,N-diethyldithiocarbamyl)benzothiazole, 2-(N,N-dibutyldithiocarbamyl)-benzotriazole and 2-N,N-dihexyl-dithiocarbamyl)benzotriazole; benzothiazole derivatives of 2-(N,N-dialkyldithiocarbamyl)toluthiazoles such as 2-(N,N-diethyldithiocarbamyl)toluthiazole, 2-(N,N-dibutyldithiocarbamyl)toluthiazole, 2-(N,N-dihexyl-dithiocarbamyl)-toluthiazole; 2-(alkyldithio)benzoxazoles such as 2-(octyldithio)benzoxazole, 2-(decyldithio)-benzoxazole and 2-(dodecyldithio)benzoxazole; benzoxazole derivatives of 2-(alkyldithio)toluoxazoles such as 2-(octyldithio)toluoxazole, 2-(decyldithio)toluoxazole, 2-(dodecyldithio)toluoxazole; 2,5-bis(alkyldithio)-1,3,4-thiadiazoles such as 2,5-bis(heptyldithio)-1,3,4-thiadiazole, 2,5-bis-(nonyldithio)-1,3,4-thiadiazole, 2,5-bis(dodecyldithio)-1,3,4-thiadiazole and 2,5-bis-(octadecyldithio)-1,3,4-thiadiazole; 2,5-bis(N,N-dialkyl-dithiocarbamyl)-1,3,4-thiadiazoles such as 2,5-bis(N,N-diethyldithiocarbamyl)-1,3,4-thiadiazole, 2,5-bis(N,N-dibutyldithiocarbamyl)-1,3,4-thiadiazole and 2,5-bis(N,N-dioctyldithiocarbamyl)-1,3,4-thiadiazole; thiadiazole derivatives of 2-N,N-dialkyldithiocarbamyl-5-mercapto-1,3,4-thiadiazoles such as 2-N,N-dibutyldithiocarbamyl-5-mercapto-1,3,4-thiadiazole and 2-N,N-dioctyldithiocarbamyl-5-mercapto-1,3,4-thiadiazole, and triazole derivatives of 1-alkyl-2,4-triazoles such as 1-dioctylaminomethyl-2,4-trizole or concentrates and/or mixtures thereof.

H. Anti-Wear Agents/Extreme Pressure Agent/Friction Reducers

Anti-wear agents/extreme pressure agent/friction reducer: zinc alkyldithiophosphates, aryl phosphates and phosphites, sulfur-containing esters, phosphosulfur compounds, and metal or ash-free dithiocarbamates.

A phosphate ester or salt may be a monohydrocarbyl, dihydrocarbyl or a trihydrocarbyl phosphate, wherein each hydrocarbyl group is saturated. In one embodiment, each hydrocarbyl group independently contains from 8 to 30, or from 12 up to 28, or from 14 up to 24, or from 14 up to 18 carbons atoms. In one embodiment, the hydrocarbyl groups are alkyl groups. Examples of hydrocarbyl groups include tridecyl, tetradecyl, pentadecyl, hexadecyl, heptadecyl, octadecyl groups and mixtures thereof.

A phosphate ester or salt is a phosphorus acid ester prepared by reacting one or more phosphorus acid or anhydride with a saturated alcohol. The phosphorus acid or anhydride is generally an inorganic phosphorus reagent, such as phosphorus pentoxide, phosphorus trioxide, phosphorus tetroxide, phosphorous acid, phosphoric acid, phosphorus halide, lower phosphorus esters, or a phosphorus sulfide, including phosphorus pentasulfide, and the like. Lower phosphorus acid esters generally contain from 1 to 7 carbon atoms in each ester group. Alcohols used to prepare the phosphorus acid esters or salts. Examples of commercially available alcohols and alcohol mixtures include Alfol 1218 (a mixture of synthetic, primary, straight-chain alcohols containing 12 to 18 carbon atoms); Alfol 20+ alcohols (mixtures of $C_{18}$-$C_{28}$ primary alcohols having mostly $C_{20}$ alcohols as determined by GLC (gas-liquid-chromatography)); and Alfo122+ alcohols ($C_{18}$-$C_{28}$ primary alcohols containing primarily $C_{22}$ alcohols). Alfol alcohols are available from Continental Oil Company. Another example of a commercially available alcohol mixture is Adol 60 (75% by weight of a straight chain $C_{22}$ primary alcohol, 15% of a $C_{20}$ primary alcohol and 8% of $C_{18}$ and $C_{24}$ alcohols). The Adol alcohols are marketed by Ashland Chemical.

A variety of mixtures of monohydric fatty alcohols derived from naturally occurring triglycerides and ranging in chain length from $C_8$-$C_{18}$ are available from Procter & Gamble Company. These mixtures contain various amounts of fatty alcohols containing 12, 14, 16, or 18 carbon atoms. For example, CO-1214 is a fatty alcohol mixture containing 0.5% of $C_{10}$ alcohol, 66.0% of $C_{12}$ alcohol, 26.0% of $C_{14}$ alcohol and 6.5% of $C_{16}$ alcohol.

Another group of commercially available mixtures include the "Neodol" products available from Shell Chemical Co. For example, Neodol 23 is a mixture of $C_{12}$ and $C_{13}$ alcohols; Neodol 25 is a mixture of $C_{12}$ to $C_{15}$ alcohols; and Neodol 45 is a mixture of $C_{14}$ to $C_{15}$ linear alcohols. The phosphate contains from 14 to 18 carbon atoms in each hydrocarbyl group. The hydrocarbyl groups of the phosphate are generally derived from a mixture of fatty alcohols having from 14 up to 18 carbon atoms. The hydrocarbyl phosphate may also be derived from a fatty vicinal diol. Fatty vicinal diols include those available from Ashland Oil under the general trade designation Adol 114 and Adol 158. The former is derived from a straight chain alpha olefin fraction of $C_{11}$-$C_{14}$, and the latter is derived from a $C_{15}$-$C_{18}$ fraction.

The phosphate salts may be prepared by reacting an acidic phosphate ester with an amine compound or a metallic base to form an amine or a metal salt. The amines may be monoamines or polyamines. Useful amines include those amines disclosed in U.S. Pat. No. 4,234,435.

The monoamines generally contain a hydrocarbyl group which contains from 1 to 30 carbon atoms, or from 1 to 12, or from 1 to 6. Examples of primary monoamines useful in the present invention include methylamine, ethylamine, propylamine, butylamine, cyclopentylamine, cyclohexylamine, octylamine, dodecylamine, allylamine, cocoamine, stearylamine, and laurylamine Examples of secondary monoamines include dimethylamine, diethylamine, dipropylamine, dibutylamine, dicyclopentylamine, dicyclohexylamine, methylbutylamine, ethylhexylamine, etc.

An amine is a fatty (C8-30) amine which includes n-octylamine, n-decylamine, n-dodecylamine, n-tetradecylamine, n-hexadecylamine, n-octadecylamine, oleyamine, etc. Also useful fatty amines include commercially available fatty amines such as "Armeen" amines (products available from Akzo Chemicals, Chicago, Ill.), such Armeen C, Armeen O, Armeen O L, Armeen T, Armeen H T, Armeen S and Armeen S D, wherein the letter designation relates to the fatty group, such as coco, oleyl, tallow, or stearyl groups.

Other useful amines include primary ether amines, such as those represented by the formula, R"(OR')xNH2, wherein R' is a divalent alkylene group having 2 to 6 carbon atoms; x is a number from one to 150, or from one to five, or one; and R" is a hydrocarbyl group of 5 to 150 carbon atoms. An example of an ether amine is available under the name SURFAM™ amines produced and marketed by Mars Chemical Company, Atlanta, Ga. Preferred etheramines are exemplified by those identified as SURFAM P14B (decyloxypropylamine), SUR- FAM P16A (linear $C_{16}$), SURFAM P17B (tridecyloxypropylamine). The carbon chain lengths (i.e., $C_{14}$, etc.) of the SURFAMs described above and used hereinafter are approximate and include the oxygen ether linkage.

An amine is a tertiary-aliphatic primary amine. Generally, the aliphatic group, preferably an alkyl group, contains from 4 to 30, or from 6 to 24, or from 8 to 22 carbon atoms. Usually the tertiary alkyl primary amines are monoamines the alkyl group is a hydrocarbyl group containing from one to 27 carbon atoms and R6 is a hydrocarbyl group containing from 1 to 12 carbon atoms. Such amines are illustrated by tert-butylamine, tert-hexylamine, 1-methyl-1-amino-cyclohexane, tert-octylamine, tert-decylamine, tert-dodecylamine, tert-tetradecylamine, tert-hexadecylamine, tert-octadecylamine, tert-tetracosanylamine, and tert-octacosanylamine. Mixtures of tertiary aliphatic amines may also be used in preparing the phosphate salt. Illustrative of amine mixtures of this type are "Primene 81R" which is a mixture of $C_{11}$-$C_{14}$ tertiary alkyl primary amines and "Primene JMT" which is a similar mixture of $C_{18}$-$C_{22}$ tertiary alkyl primary amines (both are available from Rohm and Haas Company). The tertiary aliphatic primary amines and methods for their preparation are known to those of ordinary skill in the art. An amine is a heterocyclic polyamine. The heterocyclic polyamines include aziridines, azetidines, azolidines, tetra- and dihydropyridines, pyrroles, indoles, piperidines, imidazoles, di- and tetra-hydroimidazoles, piperazines, isoindoles, purines, morpholines, thiomorpholines, N-aminoalkylmorpholines, N-aminoalkylthiomorpholines, N-aminoalkyl-piperazines, N,N'-diaminoalkylpiperazines, azepines, azocines, azonines, azecines and tetra-, di- and perhydro derivatives of each of the above and mixtures of two or more of these heterocyclic amines. Preferred heterocyclic amines are the saturated 5- and 6-membered heterocyclic amines containing only nitrogen, oxygen and/or sulfur in the hetero ring, especially the piperidines, piperazines, thiomorpholines, morpholines, pyrrolidines, and the like. Piperidine, aminoalkyl substituted piperidines, piperazine, aminoalkyl substituted piperazines, morpholine, aminoalkyl substituted morpholines, pyrrolidine, and aminoalkyl-substituted pyrrolidines, are especially preferred. Usually the aminoalkyl substituents are substituted on a nitrogen atom forming part of the hetero ring. Specific examples of such heterocyclic amines include N-aminopropylmorpholine, N-aminoethylpiperazine, and N,N"-diaminoethylpiperazine. Hydroxy heterocyclic polyamines are also useful. Examples include N-(2-hydroxyethyl)cyclohexylamine, 3-hydroxycyclopentylamine, parahydroxyaniline, N-hydroxyethylpiperazine, and the like.

The metal salts of the phosphorus acid esters are prepared by the reaction of a metal base with the acidic phosphorus ester. The metal base may be any metal compound capable of forming a metal salt. Examples of metal bases include metal oxides, hydroxides, carbonates, sulfates, borates, or the like. The metals of the metal base include Group IA, IIA, IB through VIIB, and VIII metals (CAS version of the Periodic Table of the Elements). These metals include the alkali metals, alkaline earth metals and transition metals. In one embodiment, the metal is a Group IIA metal, such as calcium or magnesium, Group IIB metal, such as zinc, or a Group VIIB metal, such as manganese. Preferably, the metal is magnesium, calcium, manganese or zinc. Examples of metal compounds which may be reacted with the phosphorus acid include zinc hydroxide, zinc oxide, copper hydroxide, copper oxide, etc.

Lubricating compositions also may include a fatty imidazoline or a reaction product of a fatty carboxylic acid and at least one polyamine. The fatty imidazoline has fatty substituents containing from 8 to 30, or from 12 to 24 carbon atoms. The substituent may be saturated or unsaturated for example, heptadeceneyl derived olyel groups, preferably saturated. In one aspect, the fatty imidazoline may be prepared by reacting a fatty carboxylic acid with a polyalkylenepolyamine, such as those discussed above. The fatty carboxylic acids are generally mixtures of straight and branched chain fatty carboxylic acids containing 8 to 30 carbon atoms, or from 12 to 24, or from 16 to 18. Carboxylic acids include the polycarboxylic acids or carboxylic acids or anhydrides having from 2 to 4 carbonyl groups, preferably 2. The polycarboxylic acids include succinic acids and anhydrides and Diels-Alder reaction products of unsaturated monocarboxylic acids with unsaturated carboxylic acids (such as acrylic, methacrylic, maleic, fumaric, crotonic and itaconic acids). Preferably, the fatty carboxylic acids are fatty monocarboxylic acids, having from 8 to 30, preferably 12 to 24 carbon atoms, such as octanoic, oleic, stearic, linoleic, dodecanoic, and tall oil acids, preferably stearic acid. The fatty carboxylic acid is reacted with at least one polyamine. The polyamines may be aliphatic, cycloaliphatic, heterocyclic or aromatic. Examples of the polyamines include alkylene polyamines and heterocyclic polyamines.

Hydroxyalkyl groups are to be understood as meaning, for example, monoethanolamine, diethanolamine or triethanolamine, and the term amine also includes diamine. The amine used for the neutralization depends on the phosphoric esters used. The EP additive according to the invention has the following advantages: It very high effectiveness when used in low concentrations and it is free of chlorine. For the neutralization of the phosphoric esters, the latter are taken and the corresponding amine slowly added with stirring. The resulting heat of neutralization is removed by cooling. The EP additive according to the invention can be incorporated into the respective base liquid with the aid of fatty substances (e.g. tall oil fatty acid, oleic acid, etc.) as solubilizers. The base liquids used are napthenic or paraffinic base oils, synthetic oils (e.g. polyglycols, mixed polyglycols), polyolefins, carboxylic esters, etc.

The composition comprises at least one phosphorus containing extreme pressure additive. Examples of such additives are amine phosphate extreme pressure additives such as that known under the trade name IRGALUBE 349 and/or triphenyl phosphorothionate extreme pressure/anti-wear additives such as that known under the trade name IRGALUBE TPPT. Such amine phosphates are suitably present in an amount of from 0.01 to 2%, preferably 0.2 to 0.6% by weight of the lubricant composition while such phosphorothionates are suitably present in an amount of from 0.01 to 3%, preferably 0.5 to 1.5% by weight of the lubricant composition. A mixture of an amine phosphate and phosphorothionate is employed.

At least one straight and/or branched chain saturated or unsaturated monocarboxylic acid which is optionally sulfurized in an amount which may be up to 35% by weight; and/or an ester of such an acid. At least one triazole or alkyl derivatives thereof, or short chain alkyl of up to 5 carbon atoms and is hydrogen, morphilino, alkyl, amido, amino, hydroxy or alkyl or aryl substituted derivatives thereof; or a triazole selected from 1,2,4-triazole, 1,2,3-triazole, 5-anilo-1,2,3,4-thiatriazole, 3-amino-1,2,4-triazole, 1-H-benzotriazole-1-yl-methylisocyanide, methylene-bis-benzotriazole and naphthotriazole; and the neutral organic phosphate which forms a component of the formulation may be present in an amount of 0.01 to 4%, preferably 1.5 to 2.5% by weight of the composition. The above amine phosphates and any of the aforementioned benzo- or tolyltriazoles can be mixed together to form a single component capable of delivering antiwear performance. The neutral organic phosphate is also a conventional ingredient of lubricating compositions and any such neutral organic phosphate falling within the formula as previously defined may be employed.

Phosphates for use in the present invention include phosphates, acid phosphates, phosphites and acid phosphites. The phosphates include triaryl phosphates, trialkyl phosphates, trialkylaryl phosphates, triarylalkyl phosphates and trialkenyl phosphates. As specific examples of these, referred to are triphenyl phosphate, tricresyl phosphate, benzyldiphenyl phosphate, ethyldiphenyl phosphate, tributyl phosphate, ethyldibutyl phosphate, cresyldiphenyl phosphate, dicresylphenyl phosphate, ethylphenyldiphenyl phosphate, diethylphenylphenyl phosphate, propylphenyldiphenyl phosphate, dipropylphenylphenyl phosphate, triethylphenyl phosphate, tripropylphenyl phosphate, butylphenyldiphenyl phosphate, dibutylphenylphenyl phosphate, tributylphenyl phosphate, trihexyl phosphate, tri(2-ethylhexyl)phosphate, tridecyl phosphate, trilauryl phosphate, trimyristyl phosphate, tripalmityl phosphate, tristearyl phosphate, and trioleyl phosphate. The acid phosphates include, for example, 2-ethylhexyl acid phosphate, ethyl acid phosphate, butyl acid phosphate, oleyl acid phosphate, tetracosyl acid phosphate, isodecyl acid phosphate, lauryl acid phosphate, tridecyl acid phosphate, stearyl acid phosphate, and isostearyl acid phosphate. The phosphites include, for example, triethyl phosphite, tributyl phosphite, triphenyl phosphite, tricresyl phosphite, tri(nonylphenyl)phosphite, tri(2-ethylhexyl)phosphite, tridecyl phosphite, trilauryl phosphite, triisooctyl phosphite, diphenylisodecyl phosphite, tristearyl phosphite, and trioleyl phosphite.

The acid phosphites include, for example, dibutyl hydrogenphosphite, dilauryl hydrogenphosphite, dioleyl hydrogenphosphite, distearyl hydrogenphosphite, and diphenyl hydrogenphosphite.

Amines that form amine salts with such phosphates include, for example, mono-substituted amines, di-substituted amines and tri-substituted amines Examples of the mono-substituted amines include butylamine, pentylamine, hexylamine, cyclohexylamine, octylamine, laurylamine, stearylamine, oleylamine and benzylamine; and those of the di-substituted amines include dibutylamine, dipentylamine, dihexylamine, dicyclohexylamine, dioctylamine, dilaurylamine, distearylamine, dioleylamine, dibenzylamine, stearyl monoethanolamine, decyl monoethanolamine, hexyl monopropanolamine, benzyl monoethanolamine, phenyl monoethanolamine, and tolyl monopropanolamine Examples of tri-substituted amines include tributylamine, tripentylamine, trihexylamine, tricyclohexylamine, trioctylamine, trilaurylamine, tristearylamine, trioleylamine, tribenzylamine, dioleyl monoethanolamine, dilauryl monopropanolamine, dioctyl monoethanolamine, dihexyl monopropanolamine, dibutyl monopropanolamine, oleyl diethanolamine, stearyl dipropanolamine, lauryl diethanolamine, octyl dipropanolamine, butyl diethanolamine, benzyl diethanolamine, phenyl diethanolamine, tolyl dipropanolamine, xylyl diethanolamine, triethanolamine, and tripropanolamine. Phosphates or their amine salts are added to the base oil in an amount of from 0.03 to 5% by weight, preferably from 0.1 to 4% by weight, relative to the total weight of the composition.

Carboxylic acids to be reacted with amines include, for example, aliphatic carboxylic acids, dicarboxylic acids (dibasic acids), and aromatic carboxylic acids. The aliphatic carboxylic acids have from 8 to 30 carbon atoms, and may be saturated or unsaturated, and linear or branched. Specific examples of the aliphatic carboxylic acids include pelargonic acid, lauric acid, tridecanoic acid, myristic acid, palmitic acid, stearic acid, isostearic acid, eicosanoic acid, behenic acid, triacontanoic acid, caproleic acid, undecylenic acid, oleic acid, linolenic acid, erucic acid, and linoleic acid. Specific examples of the dicarboxylic acids include octadecylsuccinic acid, octadecenylsuccinic acid, adipic acid, azelaic acid, and sebacic acid. One example of the aromatic carboxylic acids is salicylic acid. The amines to be reacted with carboxylic acids include, for example, polyalkylenepolyamines such as diethylenetriamine, triethylenetetramine, tetraethylenepentamine, pentaethylenehexamine, hexaethyleneheptamine, heptaethyleneoctamine, dipropylenetriamine, tetrapropylenepentamine, and hexabutyleneheptamine; and alkanolamines such as monoethanolamine and diethanolamine. Of these, preferred are a combination of isostearic acid and tetraethylenepentamine, and a combination of oleic acid and diethanolamine. The reaction products of carboxylic acids and amines are added to the base oil in an amount of from 0.01 to 5% by weight, preferably from 0.03 to 3% by weight, relative to the total weight of the composition.

Important components are phosphites, thiophosphites phosphates, and thiophosphates, including mixed materials having, for instance, one or two sulfur atoms, i.e., monothio- or dithio compounds. As used herein, the term "hydrocarbyl substituent" or "hydrocarbyl group" is used in its ordinary sense, which is well known to those skilled in the art. Specifically, it refers to a group having a carbon atom directly attached to the remainder of the molecule and having predominantly hydrocarbon character. Examples of hydrocarbyl groups include:

Hydrocarbon substituents, that is, aliphatic (e.g., alkyl or alkenyl), alicyclic (e.g., cycloalkyl, cycloalkenyl) substituents, and aromatic-, aliphatic-, and alicyclic-substituted aromatic substituents, as well as cyclic substituents wherein the ring is completed through another portion of the molecule (e.g., two substituents together form an alicyclic radical); the substituted hydrocarbon substituents; that is, substituents containing non-hydrocarbon groups which, in the context of this invention, do not alter the predominantly hydrocarbon substituent (e.g., halo (especially chloro and fluoro), hydroxy, alkoxy, mercapto, alkylmercapto, nitro, nitroso, and sulfoxy); and hetero-atom containing substituents; that is, substituents which, while having a predominantly hydrocarbon character, in the context of this invention, contain other than carbon in a ring or chain otherwise composed of carbon atoms. Heteroatoms include sulfur, oxygen, nitrogen, and encompass substituents as pyridyl, furyl, thienyl and imidazolyl. In general, no more than two, preferably no more than one, non-hydrocarbon substituent will be present for every ten carbon atoms in the hydrocarbyl group; typically, there will be no non-hydrocarbon substituents in the hydrocarbyl group.

The term "hydrocarbyl group," in the context of the present invention, is also intended to encompass cyclic hydrocarbyl or hydrocarbylene groups, where two or more of the alkyl groups in the above structures together form a cyclic structure. The hydrocarbyl or hydrocarbylene groups of the present invention generally are alkyl or cycloalkyl groups which contain at least 3 carbon atoms. Preferably or optimally containing sulfur, nitrogen, or oxygen, they will contain 4 to 24, and alternatively 5 to 18 carbon atoms. In another embodiment they contain 6, or exactly 6 carbon atoms. The hydrocarbyl groups can be tertiary or preferably primary or secondary groups; in one embodiment the component is a di(hydrocarbyl)hydrogen phosphite and each of the hydrocarbyl groups is a primary alkyl group; in another embodiment the component is a di(hydrocarbyl)hydrogen phosphite and each of the hydrocarbyl groups is a secondary alkyl group. In yet another embodiment the component is a hydrocarbylenehydrogen phosphite.

Examples of straight chain hydrocarbyl groups include methyl, ethyl, n-propyl, n-butyl, n-hexyl, n-octyl, n-decyl, n-dodecyl, n-tetradecyl, stearyl, n-hexadecyl, n-octadecyl, oleyl, and cetyl. Examples of branched-chain hydrocarbon groups include isopropyl, isobutyl, secondary butyl, tertiary butyl, neopentyl, 2-ethylhexyl, and 2,6-dimethylheptyl. Examples of cyclic groups include cyclobutyl, cyclopentyl, methylcyclopentyl, cyclohexyl, methylcyclohexyl, cycloheptyl, and cyclooctyl. A few examples of aromatic hydrocarbyl groups and mixed aromatic-aliphatic hydrocarbyl groups include phenyl, methylphenyl, tolyl, and naphthyl.

The R groups can also comprise a mixture of hydrocarbyl groups derived from commercial alcohols. Examples of some monohydric alcohols and alcohol mixtures include the commercially available "Alfol™" alcohols marketed by Continental Oil Corporation. Alfol™ 810, for instance, is a mixture containing alcohols consisting essentially of straight chain, primary alcohols having from 8 to 12 carbon atoms. Alfol™ 12 is a mixture of mostly $C_{12}$ fatty alcohols; Alfol™ 22+ comprises $C_{18}$-$C_{28}$ primary alcohols having mostly $C_{22}$ alcohols, and so on. Various mixtures of monohydric fatty alcohols derived from naturally occurring triglycerides and ranging in chain length from $C_8$ to $C_{18}$ are available from Procter & Gamble Company. "Neodol™" alcohols are available from Shell Chemical Co., where, for instance, Neodol™ 25 is a mixture of $C_{12}$ to $C_{15}$ alcohols.

Specific examples of some of the phosphites and thiophosphites within the scope of the invention include phosphorous acid, mono-, di-, or tri-thiophosphorous acid, mono-, di-, or tri-propyl phosphite or mono-, di-, or tri-thiophosphite; mono-, di-, or tri-butyl phosphite or mono-, di-, or tri-thiophosphite; mono-, di-, or tri-amyl phosphite or mono-, di-, or tri-thiophosphite; mono-, di-, or tri-hexyl phosphite or mono-, di-, or tri-thiophosphite; mono-, di-, or tri-phenyl phosphite or mono-, di-, or tri-thiophosphite; mono-, di-, or tri-tolyl phosphite or mono-, di-, or tri-thiophosphite; mono-, di-, or tri-cresyl phosphite or mono-, di-, or tri-thiophosphite; dibutyl phenyl phosphite or mono-, di-, or tri-phosphite, amyl dicresyl phosphite or mono-, di-, or tri-thiophosphite, and any of the above with substituted groups, such as chlorophenyl or chlorobutyl.

Specific examples of the phosphates and thiophosphates within the scope of the invention include phosphoric acid, mono-, di-, or tri-thiophosphoric acid, mono-, di-, or tri-propyl phosphate or mono-, di-, or tri-thiophosphate; mono-, di-, or tri-butyl phosphate or mono-, di-, or tri-thiophosphate; mono-, di-, or tri-amyl phosphate or mono-, di-, or tri-thiophosphate; mono-, di-, or tri-hexyl phosphate or mono-, di-, or tri-thiophosphate; mono-, di-, or tri-phenyl phosphate or mono-, di-, or tri-thiophosphate; mono-, di-, or tri-tritolyl phosphate or mono-, di-, or tri-thiophosphate; mono-, di-, or tri-cresyl phosphate or mono-, di-, or tri-thiophosphate; dibutyl phenyl phosphate or mono-, di-, or tri-phosphate, amyl dicresyl phosphate or mono-, di-, or tri-thiophosphate, and any of the above with substituted groups, such as chlorophenyl or chlorobutyl.

The phosphorus compounds of the present invention are prepared by well known reactions. One route the reaction of an alcohol or a phenol with phosphorus trichloride or by a transesterification reaction. Alcohols and phenols can be reacted with phosphorus pentoxide to provide a mixture of an alkyl or aryl phosphoric acid and a dialkyl or diaryl phosphoric acid. Alkyl phosphates can also be prepared by the oxidation of the corresponding phosphites. Thiophosphates can be prepared by the reaction of phosphites with elemental sulfur. In any case, the reaction can be conducted with moderate heating. Moreover, various phosphorus esters can be prepared by reaction using other phosphorus esters as starting materials. Thus, medium chain ($C_9$ to $C_{22}$) phosphorus esters have been prepared by reaction of dimethylphosphite with a mixture of medium-chain alcohols by means of a thermal transesterification or an acid- or base-catalyzed transesterification; see for example U.S. Pat. No. 4,652,416. Most such materials are also commercially available; for instance, triphenyl phosphite is available from Albright and Wilson as Duraphos TPP™; di-n-butyl hydrogen phosphite from Albright and Wilson as Duraphos DBHP™; and triphenylthiophosphate from Ciba Specialty Chemicals as Irgalube TPPT™.

The other major component of the present composition is a hydrocarbon having ethylenic unsaturation. This would normally be described as an olefin or a diene, triene, polyene, and so on, depending on the number of ethylenic unsaturations present. Preferably the olefin is monounsaturated; that is, containing only a single ethylenic double bond per molecule. The olefin can be a cyclic or a linear olefin. If a linear olefin, it can be an internal olefin or an alpha-olefin. The olefin can also contain aromatic unsaturation, i.e., one or more aromatic rings, provided that it also contains ethylenic (non-aromatic) unsaturation.

The olefin normally will contain 6 to 30 carbon atoms. Olefins having significantly fewer than 6 carbon atoms tend to be volatile liquids or gases which are not normally suitable for formulation into a composition suitable as an antiwear lubricant. Preferably the olefin will contain 6 to 18 or 6 to 12 carbon atoms, and alternatively 6 or 8 carbon atoms.

Among suitable olefins are alkyl-substituted cyclopentenes, hexenes, cyclohexene, alkyl-substituted cyclohexenes, heptenes, cycloheptenes, alkyl-substituted cycloheptenes, octenes including diisobutylene, cyclooctenes, alkyl-substituted cyclooctenes, nonenes, decenes, undecenes, dodecenes including propylene tetramer, tridecenes, tetradecenes, pentadecenes, hexadecenes, heptadecenes, octadecenes, cyclooctadiene, norbornene, dicyclopentadiene, squalene, diphenylacetylene, and styrene. Highly preferred olefins are cyclohexene and 1-octene.

Examples of esters of the dialkylphosphorodithioic acids include esters obtained by reaction of the dialkyl phosphorodithioic acid with an alpha, beta-unsaturated carboxylic acid (e.g., methyl acrylate) and, optionally an alkylene oxide such as propylene oxide.

Generally, the compositions of the present invention will contain varying amounts of one or more of the above-identified metal dithiophosphates such as from 0.01 to 2% by weight, and more generally from 0.01 to 1% by weight, based on the weight of the total composition.

The hydrocarbyl in the dithiophosphate may be alkyl, cycloalkyl, aralkyl or alkaryl groups, or a substantially hydrocarbon group of similar structure. Illustrative alkyl groups include isopropyl, isobutyl, n-butyl, sec-butyl, the various amyl groups, n-hexyl, methylisobutyl, heptyl, 2-ethylhexyl, diisobutyl, isooctyl, nonyl, behenyl, decyl, dodecyl, tridecyl, etc. Illustrative lower alkylphenyl groups include butylphenyl, amylphenyl, heptylphenyl, etc. Cycloalkyl groups likewise are useful and these include chiefly cyclohexyl and the lower alkyl-cyclohexyl radicals. Many substituted hydrocarbon groups may also be used, e.g., chloropentyl, dichlorophenyl, and dichlorodecyl.

The phosphorodithioic acids from which the metal salts useful in this invention are prepared are well known. Examples of dihydrocarbylphosphorodithioic acids and metal salts, and processes for preparing such acids and salts are found in, for example U.S. Pat. Nos. 4,263,150; 4,289,635; 4,308,154; and 4,417,990. These patents are hereby incorporated by reference.

The phosphorodithioic acids are prepared by the reaction of a phosphorus sulfide with an alcohol or phenol or mixtures of alcohols. A typical reaction involves four moles of the alcohol or phenol and one mole of phosphorus pentasulfide, and may be carried out within the temperature range from 50° to 200° C. Thus, the preparation of O,O-di-n-hexyl phosphorodithioic acid involves the reaction of a mole of phosphorus pentasulfide with four moles of n-hexyl alcohol at 100° C. for two hours. Hydrogen sulfide is liberated and the residue is the desired acid. The preparation of the metal salts of these acids may be effected by reaction with metal compounds as well known in the art.

The metal salts of dihydrocarbyldithiophosphates which are useful in this invention include those salts containing Group I metals, Group II metals, aluminum, lead, tin, molybdenum, manganese, cobalt, and nickel. The Group II metals, aluminum, tin, iron, cobalt, lead, molybdenum, manganese, nickel and copper are among the preferred metals. Zinc and copper are especially useful metals. Examples of metal compounds which may be reacted with the acid include lithium oxide, lithium hydroxide, sodium hydroxide, sodium carbonate, potassium hydroxide, potassium carbonate, silver oxide, magnesium oxide, magnesium hydroxide, calcium oxide, zinc hydroxide, strontium hydroxide, cadmium oxide, cadmium hydroxide, barium oxide, aluminum oxide, iron carbonate, copper hydroxide, lead hydroxide, tin butylate, cobalt hydroxide, nickel hydroxide, nickel carbonate, and the like.

In some instances, the incorporation of certain ingredients such as small amounts of the metal acetate or acetic acid in conjunction with the metal reactant will facilitate the reaction and result in an improved product. For example, the use of up to 5% of zinc acetate in combination with the required amount of zinc oxide facilitates the formation of a zinc phosphorodithioate with potentially improved performance properties.

Especially useful metal phosphorodithloates can be prepared from phosphorodithloic acids which in turn are prepared by the reaction of phosphorus pentasulfide with mixtures of alcohols. In addition, the use of such mixtures enables the utilization of less expensive alcohols which individually may not yield oil-soluble phosphorodithioic acids. Thus a mixture of isopropyl and hexylalcohols can be used to produce a very effective, oil-soluble metal phosphorodithioate. For the same reason mixtures of phosphorodithioic acids can be reacted with the metal compounds to form less expensive, oil-soluble salts.

The mixtures of alcohols may be mixtures of different primary alcohols, mixtures of different secondary alcohols or mixtures of primary and secondary alcohols. Examples of useful mixtures include: n-butanol and n-octanol; n-pentanol and 2-ethyl-1-hexanol; isobutanol and n-hexanol; isobutanol and isoamyl alcohol; isopropanol and 2-methyl-4-pentanol; isopropanol and sec-butyl alcohol; isopropanol and isooctyl alcohol; and the like.

Organic triesters of phosphorus acids are also employed in lubricants. Typical esters include triarylphosphates, trialkyl phosphates, neutral alkylaryl phosphates, alkoxyalkyl phosphates, triaryl phosphite, trialkylphosphite, neutral alkyl aryl phosphites, neutral phosphonate esters and neutral phosphine oxide esters. In one embodiment, the long chain dialkyl phosphonate esters are used. More preferentially, the dimethyl-, diethyl-, and dipropyl-oleyl phohphonates can be used. Neutral acids of phosphorus acids are the triesters rather than an acid (HO—P) or a salt of an acid.

Any $C_4$ to $C_8$ alkyl or higher phosphate ester may be employed in the invention. For example, tributyl phosphate (TBP) and tri isooctal phosphate (TOF) can be used. The specific triphosphate ester or combination of esters can easily be selected by one skilled in the art to adjust the density, viscosity, etc. of the formulated fluid. Mixed esters, such as dibutyl octyl phosphate or the like may be employed rather than a mixture of two or more trialkyl phosphates.

A trialkyl phosphate is often useful to adjust the specific gravity of the formulation, but it is desirable that the specific trialkyl phosphate be a liquid at low temperatures. Consequently, a mixed ester containing at least one partially alkylated with a $C_3$ to $C_4$ alkyl group is very desirable, for example, 4-isopropylphenyl diphenyl phosphate or 3-butylphenyl diphenyl phosphate. Even more desirable is a triaryl phosphate produced by partially alkylating phenol with butylene or propylene to form a mixed phenol which is then reacted with phosphorus oxychloride as taught in U.S. Pat. No. 3,576,923.

Any mixed triaryl phosphate (TAP) esters may be used as cresyl diphenyl phosphate, tricresyl phosphate, mixed xylyl cresyl phosphates, lower alkylphenyl/phenyl phosphates, such as mixed isopropylphenyl/phenyl phosphates, t-butylphenyl phenyl phosphates. These esters are used extensively as plasticizers, functional fluids, gasoline additives, flame-retardant additives and the like.

An extreme pressure agent, sulfur-based extreme pressure agents, such as sulfides, sulfoxides, sulfones, thiophosphinates, thiocarbonates, sulfurized fats and oils, sulfurized olefins and the like; phosphorus-based extreme pressure agents, such as phosphoric acid esters (e.g., tricresyl phosphate (TCP) and the like), phosphorous acid esters, phosphoric acid ester amine salts, phosphorous acid ester amine salts, and the like; halogen-based extreme pressure agents, such as chlorinated hydrocarbons and the like; organometallic extreme pressure agents, such as thiophosphoric acid salts (e.g., zinc dithiophosphate (ZnDTP) and the like) and thiocarbamic acid salts; and the like can be used. As the anti-wear agent, organomolybdenum compounds such as molybdenum dithiophosphate (MoDTP), molybdenum dithiocarbamate (MoDTC) and the like; organoboric compounds such as alkylmercaptyl borate and the like; solid lubricant anti-wear agents such as graphite, molybdenum disulfide, antimony sulfide, boron compounds, polytetrafluoroethylene and the like; and the like can be used.

The phosphoric acid ester, thiophosphoric acid ester, and amine salt thereof functions to enhance the lubricating performances, and can be selected from known compounds conventionally employed as extreme pressure agents. Generally employed are phosphoric acid esters, a thiophosphoric acid ester, or an amine salt thereof which has an alkyl group, an alkenyl group, an alkylaryl group, or an aralkyl group, any of which contains approximately 3 to 30 carbon atoms.

Examples of the phosphoric acid esters include aliphatic phosphoric acid esters such as triisopropyl phosphate, tributyl phosphate, ethyl dibutyl phosphate, trihexyl phosphate, tri-2-ethylhexyl phosphate, trilauryl phosphate, tristearyl phosphate, and trioleyl phosphate; and aromatic phosphoric acid esters such as benzyl phenyl phosphate, allyl diphenyl phosphate, triphenyl phosphate, tricresyl phosphate, ethyl diphenyl phosphate, cresyl diphenyl phosphate, dicresyl phenyl phosphate, ethylphenyl diphenyl phosphate, diethylphenyl phenyl phosphate, propylphenyl diphenyl phosphate, dipropylphenyl phenyl phosphate, triethylphenyl phosphate, tripropylphenyl phosphate, butylphenyl diphenyl phosphate, dibutylphenyl phenyl phosphate, and tributylphenyl phosphate. Preferably, the phosphoric acid ester is a trialkylphenyl phosphate.

Examples of the thiophosphoric acid esters include aliphatic thiophosphoric acid esters such as triisopropyl thiophosphate, tributyl thiophosphate, ethyl dibutyl thiophosphate, trihexyl thiophosphate, tri-2-ethylhexyl thiophosphate, trilauryl thiophosphate, tristearyl thiophosphate, and trioleyl thiophosphate; and aromatic thiophosphoric acid esters such as benzyl phenyl thiophosphate, allyl diphenyl thiophosphate, triphenyl thiophosphate, tricresyl thiophosphate, ethyl diphenyl thiophosphate, cresyl diphenyl thiophosphate, dicresyl phenyl thiophosphate, ethylphenyl diphenyl thiophosphate, diethylphenyl phenyl thiophosphate, propylphenyl diphenyl thiophosphate, dipropylphenyl phenyl thiophosphate, triethylphenyl thiophosphate, tripropylphenyl thiophosphate, butylphenyl diphenyl thiophosphate, dibutylphenyl phenyl thiophosphate, and tributylphenyl thiophosphate. Preferably, the thiophosphoric acid ester is a trialkylphenyl thiophosphate.

Also employable are amine salts of the above-mentioned phosphates and thiophosphates. Amine salts of acidic alkyl or aryl esters of the phosphoric acid and thiophosphoric acid are also employable. Preferably, the amine salt is an amine salt of trialkylphenyl phosphate or an amine salt of alkyl phosphate.

One or any combination of the compounds selected from the group consisting of a phosphoric acid ester, a thiophosphoric acid ester, and an amine salt thereof may be used.

The phosphorus acid ester and/or its amine salt function to enhance the lubricating performances, and can be selected from known compounds conventionally employed as extreme pressure agents. Generally employed are a phosphorus acid ester or an amine salt thereof which has an alkyl group, an alkenyl group, an alkylaryl group, or an aralkyl group, any of which contains approximately 3 to 30 carbon atoms.

Examples of the phosphorus acid esters include aliphatic phosphorus acid esters such as triisopropyl phosphite, tributyl phosphite, ethyl dibutyl phosphite, trihexyl phosphite, tri-2-ethylhexylphosphite, trilauryl phosphite, tristearyl phosphite, and trioleyl phosphite; and aromatic phosphorus acid esters such as benzyl phenyl phosphite, allyl diphenylphosphite, triphenyl phosphite, tricresyl phosphite, ethyl diphenyl phosphite, tributyl phosphite, ethyl dibutyl phosphite, cresyl diphenyl phosphite, dicresyl phenyl phosphite, ethylphenyl diphenyl phosphite, diethylphenyl phenyl phosphite, propylphenyl diphenyl phosphite, dipropylphenyl phenyl phosphite, triethylphenyl phosphite, tripropylphenyl phosphite, butylphenyl diphenyl phosphite, dibutylphenyl phenyl phosphite, and tributylphenyl phosphite. Also favorably employed are dilauryl phosphite, dioleyl phosphite, dialkyl phosphites, and diphenyl phosphite. Preferably, the phosphorus acid ester is a dialkyl phosphite or a trialkyl phosphite.

The phosphate salt may be derived from a polyamine. The polyamines include alkoxylated diamines, fatty polyamine diamines, alkylenepolyamines, hydroxy containing polyamines, condensed polyamines arylpolyamines, and heterocyclic polyamines. Commercially available examples of alkoxylated diamines include those amine where y in the above formula is one. Examples of these amines include Ethoduomeen T/13 and T/20 which are ethylene oxide condensation products of N-tallowtrimethylenediamine containing 3 and 10 moles of ethylene oxide per mole of diamine, respectively.

In another embodiment, the polyamine is a fatty diamine. The fatty diamines include mono- or dialkyl, symmetrical or asymmetrical ethylene diamines, propane diamines (1,2, or 1,3), and polyamine analogs of the above. Suitable commercial fatty polyamines are Duomeen C. (N-coco-1,3-diaminopropane), Duomeen S(N-soya-1,3-diaminopropane), Duomeen T (N-tallow-1,3-diaminopropane), and Duomeen O (N-oleyl-1,3-diaminopropane). "Duomeens" are commercially available from Armak Chemical Co., Chicago, Ill.

Such alkylenepolyamines include methylenepolyamines, ethylenepolyamines, butylenepolyamines, propylenepolyamines, pentylenepolyamines, etc. The higher homologs and related heterocyclic amines such as piperazines and N-amino alkyl-substituted piperazines are also included. Specific examples of such polyamines are ethylenediamine, triethylenetetramine, tris-(2-aminoethyl)amine, propylenediamine, trimethylenediamine, tripropylenetetramine, tetraethylenepentamine, hexaethyleneheptamine, pentaethylenehexamine, etc. Higher homologs obtained by condensing two or more of the above-noted alkyleneamines are similarly useful as are mixtures of two or more of the aforedescribed polyamines.

In one embodiment the polyamine is an ethylenepolyamine. Such polyamines are described in detail under the heading Ethylene Amines in Kirk Othmer's "Encyclopedia of Chemical Technology", 2d Edition, Vol. 7, pages 22-37, Interscience Publishers, New York (1965). Ethylenepolyamines are often a complex mixture of polyalkylenepolyamines including cyclic condensation products.

Other useful types of polyamine mixtures are those resulting from stripping of the above-described polyamine mixtures to leave, as residue, what is often termed "polyamine bottoms". In general, alkylenepolyamine bottoms can be characterized as having less than 2%, usually less than 1% (by weight) material boiling below 200° C. A typical sample of such ethylene polyamine bottoms obtained from the Dow Chemical Company of Freeport, Tex. designated "E-100". These alkylenepolyamine bottoms include cyclic condensation products such as piperazine and higher analogs of diethylenetriamine, triethylenetetramine and the like. These alkylenepolyamine bottoms can be reacted solely with the acylating agent or they can be used with other amines, polyamines, or mixtures thereof. Another useful polyamine is a condensation reaction between at least one hydroxy compound with at least one polyamine reactant containing at least one primary or secondary amino group. The hydroxy compounds are preferably polyhydric alcohols and amines. The polyhydric alcohols are described below. (See carboxylic ester dispersants.) In one embodiment, the hydroxy compounds are polyhydric amines Polyhydric amines include any of the above-described monoamines reacted with an alkylene oxide (e.g., ethylene oxide, propylene oxide, butylene oxide, etc.) having from two to 20 carbon atoms, or from two to four. Examples of polyhydric amines include tri-(hydroxypropyl) amine, tris-(hydroxymethyl)amino methane, 2-amino-2-methyl-1,3-propanediol, N,N,N',N'-tetrakis(2-hydroxypropyl) ethylenediamine, and N,N,N',N'-tetrakis(2-hydroxyethyl) ethylenediamine, preferably tris(hydroxymethyl) aminomethane (THAM).

Polyamines which react with the polyhydric alcohol or amine to form the condensation products or condensed amines, are described above. Preferred polyamines include triethylenetetramine (TETA), tetraethylenepentamine (TEPA), pentaethylenehexamine (PEHA), and mixtures of polyamines such as the above-described "amine bottoms".

Examples of extreme pressure additives include sulfur-based extreme pressure additives such as dialkyl sulphides, dibenzyl sulphide, dialkyl polysulphides, dibenzyl disulphide, alkyl mercaptans, dibenzothiophene and 2,2'-dithiobis (benzothiazole); phosphorus-based extreme pressure additives such as trialkyl phosphates, triaryl phosphates, trialkyl phosphonates, trialkyl phosphites, triaryl phosphites and dialkylhydrozine phosphites, and phosphorus- and sulfur-based extreme pressure additives such as zinc dialkyldithiophosphates, dialkylthiophosphoric acid, trialkyl thiophosphate esters, acidic thiophosphate esters and trialkyl trithiophosphates. These extreme pressure additives can be used individually or in the form of mixtures, conveniently in an amount within the range from 0.1 to 2 parts by weight, per 100 parts by weight of the base oil.

All the above can be performance enhanced using a variety of cobase stocks, AN, AB, ADPO, ADPS, ADPM, and/or a variety of mono-basic, di-basic, and tribasic esters in conjunction with low sulfur, low aromatic, low iodine number, low bromine number, high analine point, isoparafin.

The following are examples of the present disclosure and are not to be construed as limiting.

EXAMPLES

We have discovered several novel lubricant base stock formulations and lubricant formulations that provide enhanced air release properties.

Example 1

Blends of Group I Base Stock and n-Heptane

A Group I heavy neutral base stock was blended with n-heptane. The Group I HN base stock has a kinematic viscosity at 100° C. of approximately 11 to 12 cSt. The amount of n-heptane in the base stock was measured by gas chromatography. The air release of the blends with different amounts of n-heptane was measured at 0.2% using the ASTM D3427 method. The results are indicated in the Table below.

Table of Air Release Versus Residual $C_7$ in Group I HN:

| Sample | $C_7$ Loading wt % | Air Release at 0.2% (min) | % Decrease in Air Release |
|---|---|---|---|
| 1 | 0 | 19.9 | |
| 2 | 0 | 19.2 | |
| 3 | 0.02 | 19.3 | 1.3 |
| 4 | 0.02 | 16 | 18.2 |
| 5 | 0.02 | 17 | 13.0 |
| 6 | 0.02 | 15.2 | 22.3 |
| 7 | 0.03 | 19 | 2.8 |
| 8 | 0.33 | 17.6 | 10.0 |
| 9 | 0.37 | 17.8 | 9.0 |
| 10 | 0.6 | 6.6 | 66.2 |
| 11 | 0.65 | 3.2 | 83.6 |

As can be seen in the above Table, when the n-heptane in the Group I HN base stock is 0.60 wt % and greater, there is a surprising and unexpected decrease in air release at 0.2% to values of 6.6 minutes and lower, which represents a 66 to 84% decrease relative to the base stock without any n-heptane. At n-heptane levels of below 0.60%, the air release values are in the range of 16 to 20 minutes (1 to 22% decreases relative to the base stock without any n-heptane).

Example 2

Blends of Group I Base Stock and PAO

A Group I heavy neutral base stock was blended with a 6 cSt PAO fluid (PAO-6). Blends with different amounts of PAO-6 in the base stock were prepared and the resulting base stock blends were measured for air release at 0.2% using the ASTM D3427 method. The results are plotted in FIG. 1.

As can be seen in FIG. 1, when the PAO-6 loading in the Group I HN is greater than or equal to 1.0 wt. %, there is a surprising and unexpected decrease in air release % to values of 12 minutes and lower (almost a 50% decrease relative to the Group I HN base stock without the PAO-6). At PAO-6 levels of 0.5% and lower, the air release values are 20 and greater.

Example 3

Different Lots of Group I Base Stock and PAO

Different lots of a Group I heavy neutral base stock were blended with a 6 cSt PAO fluid (PAO-6) to determine the variability in air release values. Also control samples of the same lots with no PAO-6 were measured for air release. The results in the Table below indicate that there is a decrease in air release ranging from 6 to 17% with 1 wt % addition of PAO-6 to the Group I base stock.

| Sample | PAO-6 wt % | Air Release at 0.2% (min) | % Decrease in Air Release |
|---|---|---|---|
| 7046280 | 0 | 21.93 | |
| 7046280 | 1 | 19.32 | 11.9 |
| 7040840 | 0 | 19.22 | |
| 7040840 | 1 | 17.82 | 7.3 |
| 7047858 | 0 | 22.32 | |
| 7047858 | 1 | 18.5 | 17.1 |
| 7023057 | 0 | 17.92 | |
| 7023057 | 1 | 16.82 | 6.1 |
| 5037978 | 0 | 18.4 | |
| 5037978 | 1 | 16.9 | 8.3 |

Example 4

Different Paraffinic Molecules in Group I Base Stock

Different paraffinic molecules were added to a Group I HN base stock at 1 wt %. The air release values were measured and compared to the air release of the Group I HN base stock not containing any paraffinic molecules (21.8 minutes at 0.2% air). These values are shown in the Table below along with the relative decrease and the % decrease in the air release for each type of paraffinic molecule relative to the Group I HN with no paraffinics. It can be seen that each of the paraffinic molecules in the Group I HN base stock at 1 wt % decreased the air release in the range of 8 to almost 50%. Visom 4 and Visom 6 are 4 cSt and 6 cSt Group III base stocks respectively. The addition of GTL heavy was the least effective in decreasing the air release of the Group I HN base stock as it only decreased the air release 8.2% relative to the Group I HN with no paraffinic.

| | Time to 0.2% air | Delta Air Release | % Decrease in AR |
|---|---|---|---|
| AP/E Core 600 1041560 | 21.8 | | |
| +1% of | | | |
| PAO 4 | 12 | 9.8 | 45.0 |
| PAO 6 | 11 | 9.5 | 49.5 |
| n-dodecane | 13.3 | 8.5 | 39.0 |
| nonadecane | 13.7 | 8.1 | 37.2 |
| visom 4 | 13.8 | 8 | 36.7 |
| visom 6 | 14.02 | 7.78 | 35.7 |

-continued

| | Time to 0.2% air | Delta Air Release | % Decrease in AR |
|---|---|---|---|
| PAO 40 | 14.5 | 7.3 | 33.5 |
| n-hexadecane | 14.52 | 7.28 | 33.4 |
| Test effect of GTL4 | 15.42 | 6.38 | 29.3 |
| PAO 2 | 15.73 | 6.07 | 27.8 |
| cyclohexane | 16.4 | 5.4 | 24.8 |
| PAO 10 Cst | 16.52 | 5.28 | 24.2 |
| GTL6 | 17.32 | 4.48 | 20.6 |
| GTL heavy | 20.02 | 1.78 | 8.2 |

Example 5

Impact of Lubricant Additives in Group I Base Stock

Certain lubricant additives have a negative impact on air release when added to a Group I base stock. One of such additives is a detergent. An alkaline sulfonate detergent (OLOA 249SX) was added to a Group I base stock and the air release measured. The air release at 0.2% air of the base stock was 6.62 minutes. The air release at 0.2% air of the Group I base stock with 0.02 wt % of the alkaline sulfonate increased to 16.72 minutes. Then 1 wt % of PAO-6 was added to the Group I base stock containing 0.02 wt % alkaline sulfonate and the air release at 0.2% air decreased to 6.52 minutes. Hence, the addition of 1 wt % PAO had a dramatic impact (61% decrease) in mitigating the increase in air release caused by the inclusion of detergent in the lubricant formulation. In fact, the inclusion of 1 wt % PAO decreased the air release to even lower levels than the Group I base stock with no additives.

Example 6

Group II Base Stock with Additives and PAO-6

A Group II base stock was measured for air release at 0.2% air and was found to be 6.32 minutes. Then 1 wt % of PAO-6 was added to the Group II base stock and the air release at 0.2% air decreased to 3.2 minutes (49.4% decrease). Then 0.001 wt % of a detergent (ester succinimide) was added to the Group II base stock (with no PAO-6) and the air release increased to 6.6 minutes. Then 1 wt. % PAO-6 was added to the formulation with 0.001 wt. % (ester succinimide) in the Group II base stock and the air release decreased to 4.12 minutes (37.6% decrease). The results indicate that PAO is also effective in decreasing the air release of Group II base stocks and also mitigating the negative effects on air release caused by the inclusion of detergent additives in Group II base stocks.

Example 7

Methanol Extraction of Group I Base Stock 4 different lots of a Group I HN base stock were measured for air release at 0.2% air with the values ranging from 13.42 to 21.93 minutes. Each of the base stocks was then extracted with methanol and the air release measured thereafter. As shown in the Table below, the air release values decreased for each of the four lots and ranged from 6.8 to 17.0 minutes, which represents from a 22 to 35% decrease in air release relative to the unextracted Group I HN base stock. Group II base stocks are expected to show a similar decrease in air release values after extraction with methanol.

| Midas # | AR before methanol extraction | AR after methanol extraction | % Decrease in AR |
|---|---|---|---|
| 07-46280 | 21.93 | 17.02 | 22.4 |
| 07-47857 | 10.92 | 6.82 | 37.5 |
| 09-30579 | 13.42 | 9.3 | 30.7 |
| 10-41560 | 21.8 | 14.2 | 34.9 |

While the examples have been to Group I heavy neutral base stocks and Group II base stocks, these examples are not intended to be limiting. The Group I and Group II base stocks with improved air release properties are expected to also apply to blends of Group I and Group II base stocks as well as fully formulated lubricant compositions made from these base stocks.

PCT and EP Clauses:

1. A method of mitigating air release in lubricant base stocks comprising: providing a Group I base stock, a Group II base stock or a combination thereof, and adding to the base stock an effective amount of a $C_7$ to $C_{80}$ paraffin, wherein the lubricant base stock provides air release according to the ASTM D3427 test of at least 20% lower than the same base stock not including the $C_7$ to $C_{80}$ paraffin.

2. The method of clause 1, wherein an effective amount of the $C_7$ to $C_{80}$ paraffin ranges from 0.02 to 10 wt %.

3. The method of clauses 1-2, wherein the $C_7$ to $C_{80}$ paraffin is chosen from n-hexane, n-heptane, n-dodecane, nonadecane, n-hexadecane, cyclohexane, PAO, and GTL.

4. The method of clauses 1-3, wherein the Group I base stock is chosen from Group I light neutral, Group I heavy neutral and bright stock.

5. A lubricant base stock with improved air release comprising: a Group I base stock, a Group II base stock or a combination thereof and an effective amount of $C_7$ to $C_{80}$ paraffin, wherein the lubricant base stock provides air release according to the ASTM D3427 test of at least 20% lower than the same base stock not including the $C_7$ to $C_{80}$ paraffin.

6. The base stock of clause 5, wherein an effective amount of the $C_7$ to $C_{80}$ paraffin ranges from 0.02 to 10 wt %.

7. The base stock of clauses 5-6, wherein the $C_7$ to $C_{80}$ paraffin is chosen from n-hexane, n-heptane, n-dodecane, nonadecane, n-hexadecane, cyclohexane, PAO, and GTL.

8. The base stock of clauses 5-7, wherein the Group I base stock is chosen from Group I light neutral, Group I heavy neutral and bright stock.

9. A method of mitigating air release in lubricating oils comprising: providing a lubricating oil composition comprising a Group I base stock, a Group II base stock or a combination thereof and adding to the lubricating oil composition an effective amount of $C_7$ to $C_{80}$ paraffin, wherein the lubricant oil provides air release according to the ASTM D3427 test of at least 20% lower than the same lubricating oil not including the $C_7$ to $C_{80}$ paraffin.

10. The method of clause 9, wherein the lubricating oil composition further includes at least one additive chosen from antiwear, antioxidant, defoamant, demulsifier, detergent, dispersant, metal passivator, friction reducer, rust inhibitor, and any combination thereof.

11. The method of clauses 9-10, wherein the detergent is chosen from an alkaline sulfonate, an ester succinimide, and combinations thereof.

12. The method of clauses 9-11 wherein an effective amount of the $C_7$ to $C_{80}$ paraffin ranges from 0.02 to 10 wt %.

13. The method of clauses 9-12, wherein the $C_7$ to $C_{80}$ paraffin is chosen from n-hexane, n-heptane, n-dodecane, nonadecane, n-hexadecane, cyclohexane, PAO, and GTL.

14. A lubricating oil with improved air release comprising: a lubricating oil composition comprising a Group I base stock, a Group II base stock or a combination thereof and an effective amount of $C_7$ to $C_{80}$ paraffin, wherein the lubricating oil air release according to the ASTM D3427 test is at least 20% lower than the same lubricating oil not including the $C_7$ to $C_{80}$ paraffin.

15. The lubricating oil of clause 14, wherein the lubricating oil composition further includes at least one additive chosen from antiwear, antioxidant, defoamant, demulsifier, detergent, dispersant, metal passivator, friction reducer, rust inhibitor, and any combination thereof.

16. The lubricating oil of clauses 14-15, wherein the detergent is chosen from an alkaline sulfonate, an ester succinimide, and combinations thereof.

17. The lubricating oil of clauses 14-16, wherein an effective amount of the $C_7$ to $C_{80}$ paraffin ranges from 0.02 to 10 wt. %.

18. The lubricating oil of clauses 14-17, wherein the $C_7$ to $C_{80}$ paraffin is chosen from n-hexane, n-heptane, n-dodecane, nonadecane, n-hexadecane, cyclohexane, PAO, and GTL.

19. A method of making a lubricant base stock with improved air release properties comprising: providing a Group I base stock, a Group II base stock or a combination thereof and extracting the base stock with a solvent chosen from methanol, ethanol, propanol, NMP, furfural, tetrahydrofuran, and DMSO, wherein the air release time to 0.2% air in the ASTM D3427 test of the lubricant base stock is at least 20% lower than the same base stock without the extraction step.

Applicants have attempted to disclose all embodiments and applications of the disclosed subject matter that could be reasonably foreseen. However, there may be unforeseeable, insubstantial modifications that remain as equivalents. While the present invention has been described in conjunction with specific, exemplary embodiments thereof, it is evident that many alterations, modifications, and variations will be apparent to those skilled in the art in light of the foregoing description without departing from the spirit or scope of the present disclosure. Accordingly, the present disclosure is intended to embrace all such alterations, modifications, and variations of the above detailed description.

All patents, test procedures, and other documents cited herein, including priority documents, are fully incorporated by reference to the extent such disclosure is not inconsistent with this invention and for all jurisdictions in which such incorporation is permitted.

When numerical lower limits and numerical upper limits are listed herein, ranges from any lower limit to any upper limit are contemplated.

What is claimed is:

1. A method of mitigating air release in lubricant base stocks comprising:

providing a Group I base stock, a Group II base stock or a combination thereof which are substantially free of additives, and adding to the base stock an effective amount of a $C_6$ to $C_{80}$ paraffin, wherein the lubricant base stock provides air release according to the ASTM D3427 test of at least 20% lower than the same base stock not including the $C_6$ to $C_{80}$ paraffin, wherein no other additives are added to the base stock prior to or during the step of adding the $C_6$ to $C_{80}$ paraffin to the base stock, wherein the effective amount of the $C_6$ to $C_{80}$ paraffin ranges from 0.02 to 8 wt %, and wherein the $C_6$ to $C_{80}$ paraffin is chosen from the group consisting of n-hexane, n-heptane, n-dodecane, nonadecane, n-hexadecane, and cyclohexane.

2. The method of claim 1, wherein the $C_6$ to $C_{80}$ paraffin is n-heptane.

3. The method of claim 2, wherein the Group I base stock is chosen from the group consisting of Group I light neutral, Group I heavy neutral and bright stock.

4. A lubricant base stock with improved air release comprising:

a Group I base stock, a Group II base stock or a combination thereof and an effective amount of $C_6$ to $C_{80}$ paraffin, wherein the lubricant base stock provides air release according to the ASTM D3427 test of at least 20% lower than the same base stock not including the $C_6$ to $C_{80}$ paraffin, wherein the base stock and the $C_6$ to $C_{80}$ paraffin are substantially free of additives, wherein the effective amount of the $C_6$ to $C_{80}$ paraffin ranges from 0.02 to 8 wt %, and wherein the $C_6$ to $C_{80}$ paraffin is chosen from the group consisting of n-hexane, n-heptane, n-dodecane, nonadecane, n-hexadecane, and cyclohexane.

5. The base stock of claim 4, wherein the $C_6$ to $C_{80}$ paraffin is n-heptane.

6. The base stock of claim 5, wherein the Group I base stock is chosen from the group consisting of Group I light neutral, Group I heavy neutral and bright stock.

7. A method of making a lubricant base stock with improved air release properties comprising:

providing a Group I base stock, a Group II base stock or a combination thereof which are substantially free of additives and adding to the base stock an effective amount of $C_6$ to $C_{80}$ paraffin, wherein the lubricant base stock provides air release according to the ASTM D3427 test of at least 20% lower than the same base stock not including the $C_6$ to $C_{80}$ paraffin, wherein no other additives are added to the base stock prior to or during the step of adding the $C_6$ to $C_{80}$ paraffin to the base stock, wherein the effective amount of the $C_6$ to $C_{80}$ paraffin ranges from 0.02 to 8 wt %, and wherein the $C_6$ to $C_{80}$ paraffin is chosen from the group consisting of n-hexane, n-heptane, n-dodecane, nonadecane, n-hexadecane, and cyclohexane.

8. The method of claim 7, wherein the $C_6$ to $C_{80}$ paraffin is n-heptane.

9. The method of claim 8, wherein the Group I base stock is chosen from the group consisting of Group I light neutral, Group I heavy neutral and bright stock.

10. A method of mitigating air release in lubricating oils comprising:

providing a lubricant base stock with improved air release comprising a Group I base stock, a Group II base stock or a combination thereof and an effective amount of $C_6$ to $C_{80}$ paraffin, wherein the lubricant base stock provides air release according to the ASTM D3427 test of at least 20% lower than the same base stock not including the $C_6$ to $C_{80}$ paraffin, wherein the base stock and the $C_6$ to $C_{80}$ paraffin are substantially free of additives, and adding to the lubricant base stock at least one additive, wherein the effective amount of the $C_6$ to $C_{80}$ paraffin ranges from 0.02 to 8 wt %, and wherein the $C_6$ to $C_{80}$ paraffin is chosen from the group consisting of n-hexane, n-heptane, n-dodecane, nonadecane, n-hexadecane, and cyclohexane.

11. The method of claim 10, wherein the at least one additive is chosen from the group consisting of antiwear, antioxidant, defoamant, demulsifier, detergent, dispersant, metal passivator, friction reducer, rust inhibitor, and any combination thereof.

12. The method of claim 11, wherein the detergent is chosen from the group consisting of an alkaline sulfonate, an ester succinimide, and combinations thereof.

* * * * *